US007088263B1

(12) United States Patent
Krause et al.

(10) Patent No.: US 7,088,263 B1
(45) Date of Patent: Aug. 8, 2006

(54) RUNWAY APPROACH LIGHTING SYSTEM AND METHOD

(75) Inventors: Kenneth Nicholas Krause, Madison Heights, MI (US); Vincent Robert Busby, Windsor (CA)

(73) Assignee: Controlled Power Company, Troy, MI (US)

( * ) Notice: Subject to any disclaimer, the term of this patent is extended or adjusted under 35 U.S.C. 154(b) by 136 days.

(21) Appl. No.: 10/942,067

(22) Filed: Sep. 15, 2004

Related U.S. Application Data

(63) Continuation-in-part of application No. 10/863,421, filed on Jun. 8, 2004.

(60) Provisional application No. 60/603,972, filed on Aug. 24, 2004.

(51) Int. Cl.
*G08G 5/00* (2006.01)

(52) U.S. Cl. ..... 340/947; 340/951; 340/953; 340/985; 362/559; 244/114 R; 342/33

(58) Field of Classification Search ..... 340/947, 340/951, 953, 985; 362/559; 244/114 R; 342/33
See application file for complete search history.

(56) References Cited

U.S. PATENT DOCUMENTS

| | | | | |
|---|---|---|---|---|
| 3,710,157 | A | 1/1973 | Wright | |
| 3,715,741 | A | 2/1973 | McWade et al. | |
| 3,795,905 | A | 3/1974 | Wright | |
| 3,828,334 | A | 8/1974 | Wallace | |
| 3,829,735 | A | 8/1974 | Berlock et al. | |
| 3,964,015 | A | 6/1976 | Collins | |
| 4,095,140 | A | 6/1978 | Kirkhuff et al. | |
| 4,138,627 | A | 2/1979 | Camic | |
| 4,216,413 | A | 8/1980 | Plas | |
| 4,297,632 | A | 10/1981 | Glaser et al. | |
| 4,449,073 | A | 5/1984 | Mongoven et al. | |
| 4,486,691 | A | 12/1984 | Beggs | |
| 5,408,171 | A | 4/1995 | Eitzmann et al. | |
| 5,446,277 | A | 8/1995 | Rutter | |
| 5,519,618 | A | 5/1996 | Kastner et al. | |
| 5,638,057 | A | 6/1997 | Williams | |
| 6,028,535 | A | 2/2000 | Rizkin | |
| 6,573,840 | B1 | 6/2003 | Norman et al. | |
| 6,812,652 | B1 * | 11/2004 | Munson et al. | 315/274 |
| 2005/0030192 | A1 * | 2/2005 | Weaver et al. | 340/815.45 |

* cited by examiner

*Primary Examiner*—Jeffery Hofsass
*Assistant Examiner*—Samuel J Walk
(74) *Attorney, Agent, or Firm*—Reising, Ethington, Barnes, Kisselle, P.C.

(57) ABSTRACT

A method and system for visually guiding an aircraft in its landing approach to a runway having an approach area equipped with approach lights operable in off, low, medium, and high intensity states. The lights are communicated with a secondary side of a transformer, which has a primary side with low, medium, and high taps that correspond to the light states. Off, low, medium, and high lighting intensity requests correspond to the low, medium, and high states of the plurality of lights. AC power is switched between the transformer taps in response to a request for an increase in lighting intensity. Power is sequentially applied to the taps by supplying the power to the low tap for a first predetermined time interval before supplying the power to the medium tap.

13 Claims, 26 Drawing Sheets

134
120 VAC IN
120 VAC OUT
FLASHER ON RELAY
120 VOLT FLASHER PWR
FLASHER MEDIUM TEST
FLASHER HIGH TEST
120 VOLT APPROACH PWR
J5
L1
500 UHY
Z18
Z175LA20A
C49
.1 MFD
OP11
IL4208
R38
24 OHM
R39
24 OHM
C11
.022MFD
C28
.022 MFD
AT11
R11
470
R62
18K
Z11
+6
D7
D8
1N4004
OP17
IL4208
R50
24 OHM
R51
24 OHM
C17
.022MFD
C34
.022 MFD
AT17
R17
470
R68
18K
Z17
J6
K5
+ S.S.R.
- S.S.R.
R137
470 OHM
Q1
2N4401
R112
1K
R111
10 OHM
R113
10 K
R115
1K
T1
ST4-20
D2
1N4004
D3
1N4004
+8
REG1
+5.0
SPX29150U
C50
3300 MFD
GND
+6
C51
4.7 MFD
R114 10K
REG2
+3.3
SPX1117T
+3.3
TP1
C54
100 MED
U5
HC14
150

RUNWAY APPROACH LIGHTING SYSTEM AND METHOD

CROSS-REFERENCES TO RELATED APPLICATIONS

The present invention is a continuation-in-part of and is related to pending non-provisional application Ser. No. 10/863,421, filed Jun. 8, 2004, and entitled "RUNWAY APPROACH LIGHTING SYSTEM AND METHOD", by Krause et al, and to provisional application Ser. No. 60/603,972, filed on Aug. 24, 2004, and also entitled "RUNWAY APPROACH LIGHTING SYSTEM AND METHOD". Each of the above listed cross-references is assigned to the assignee of the present invention, is incorporated by reference herein, and domestic priority is claimed thereto.

FIELD OF THE INVENTION

This invention relates generally to aircraft indicating systems and methods, and more particularly to visual aircraft landing guidance systems and methods.

BACKGROUND OF THE INVENTION

Visual landing guidance systems for aircraft are widely used throughout the world as an aid for guiding an aircraft in descent to a runway. Such systems include the medium intensity approach lighting system with runway alignment indicator lights (MALSR), developed by the United States Federal Aviation Administration (FAA). In general, MALSR provides visual guidance to landing aircraft in an approach area of an active landing runway. More specifically, MALSR provides visual information regarding the lateral position of approaching landing aircraft relative to the location of the runway centerline and thereby enables an aircraft pilot to acquire the runway centerline well in advance of landing the aircraft, especially in low visibility conditions.

A typical MALSR includes a combination of three independent guidance lighting arrays that are laid out on a runway approach and that include a threshold array, a steady-burning array, and a sequenced flasher array. FIG. 5 depicts a typical MALSR lighting arrangement. The threshold array includes 18 to 32 steady-burning light sources that are arranged in a line perpendicular to the centerline of the runway, at the threshold of the runway. At each of the opposite flanks of the threshold array, there is positioned a flashing runway-end-indicator-light (REIL). The steady-burning array includes nine light bars, each having five steady-burning light sources mounted thereto. Seven of the lightbars are evenly spaced at intervals of 200 feet, beginning 200 feet from the runway threshold. The other two lightbars, or wing lights, are disposed on either side of the lightbar at the 1,000 foot mark. The sequenced flasher array includes 5 to 8 flasher light sources that are evenly spaced at intervals of 200 feet, beginning 1,600 feet from the runway threshold. In operation, the sequenced flasher array gives the appearance of a rolling ball of light headed toward the runway down the centerline thereof. The lighting arrays operate in accordance with an off mode and an on mode having three different levels of lighting intensity—low, medium, and high.

Unfortunately, however, current MALSR's are susceptible to relatively frequent electrical failure. For example, the circuitry and components of MALSR's are susceptible to severe direction swings and magnitude surges in transformer excitation currents, typically caused by unintentional simultaneous operation of two of the three lighting intensity levels when switching between the different levels. These swings and surges yield damaging electrical transients that lead to overstressing and premature failure of transformers, switch contactors, control circuit boards, the lamps and the like. Moreover, the lightbars are particularly vulnerable to lightning strikes, which fault out the MALSR. As a result of the above types of electrical failures, the MALSR must be diagnosed and repaired to return the MALSR to normal operation, which can take hours or days. Diagnosis, repair, replacement of prematurely failed components, or simple reset of the MALSR creates guidance system down-time that, at best, is time consuming and expensive, and, at worst, increases the risk of landing an aircraft.

SUMMARY OF THE INVENTION

According to one aspect of the present invention, there is provided an aircraft landing guidance system for visually guiding an aircraft in its landing approach to a runway having an approach area equipped with a plurality of lights operable in accordance with a plurality of intensity states including at least an off state, a low state, a medium state, and a high state. The plurality of lights is communicated to a secondary side of a transformer, which also has a primary side with a plurality of taps including at least low, medium, and high taps that correspond respectively to the low, medium, and high states of the plurality of lights. The system includes at least one input source for requesting the plurality of lights to operate in accordance with the plurality of intensity states. The at least one input source receives a plurality of lighting intensity requests including an off request, a low request, a medium request, and a high request that correspond respectively to the low, medium, and high states of the plurality of lights. The at least one input source is capable of receiving a request for an increase in lighting intensity from one of the states to another. The system also includes a plurality of power input lines communicated to the plurality of taps of the transformer. The plurality of power input lines includes a low line, a medium line, and a high line that correspond respectively to the low, medium, and high taps of the transformer. The system further includes a plurality of switches for switching between the plurality of taps of the transformer and includes a low tap switch in the low line, a medium tap switch in the medium line, and a high tap switch in the high line. The system additionally includes a control module in communication with the at least one input source and the plurality of switches. The control module includes control logic for controlling operation of the plurality of switches in a predetermined sequential manner based on input received from the input source. The control logic activates at least one of the plurality of switches in response to the request for an increase in lighting intensity from the input source. The control logic first activates the low tap switch for a first predetermined time interval before activating the medium tap switch for at least a second predetermined time interval.

According to another aspect of the present invention, there is provided a method of visually guiding an aircraft in its landing approach to a runway having an approach area equipped with a plurality of lights operable in accordance with a plurality of intensity states including at least an off state, a low state, a medium state, and a high state. The plurality of lights is communicated with a secondary side of a transformer, which also has a primary side with a plurality of taps including at least low, medium, and high taps that correspond respectively to the low, medium, and high states of the plurality of lights. The method includes a step of receiving and processing a plurality of lighting intensity requests including an off request, a low request, a medium request, and a high request that correspond respectively to the low, medium, and high states of the plurality of lights. The method also includes a step of switching supply of AC power between the plurality of taps of the transformer in response to a request for an increase in lighting intensity from the receiving and processing step. The switching step includes sequentially supplying the power to the plurality of taps by supplying the power to the low tap for a first predetermined time interval before supplying the power to the medium tap.

At least some of the objects, features and advantages that may be achieved by at least certain embodiments of the invention include providing a system that provides forced progressive increases in lighting intensity to prevent jumps from off or low intensity settings to medium or high intensity settings thereby minimizing transformer excitation; prevents simultaneous operation of switches without power dropout; extends the life of approach lighting lamps; allows for bypass operation; reduces operating expenses and runway downtime; is of relatively simple design and economical manufacture and assembly; and is reliable and has a long, useful service life.

Of course, other objects, features and advantages will be apparent in view of this disclosure to those skilled in the art. Other systems or methods embodying the invention may achieve more or less than the noted objects, features or advantages.

BRIEF DESCRIPTION OF THE DRAWINGS

These and other objects, features and advantages of the present invention will be apparent from the following detailed description of the preferred embodiment and best mode, appended claims, and accompanying drawings in which:

DETAILED DESCRIPTION OF THE PREFERRED EMBODIMENTS

Figure 1:
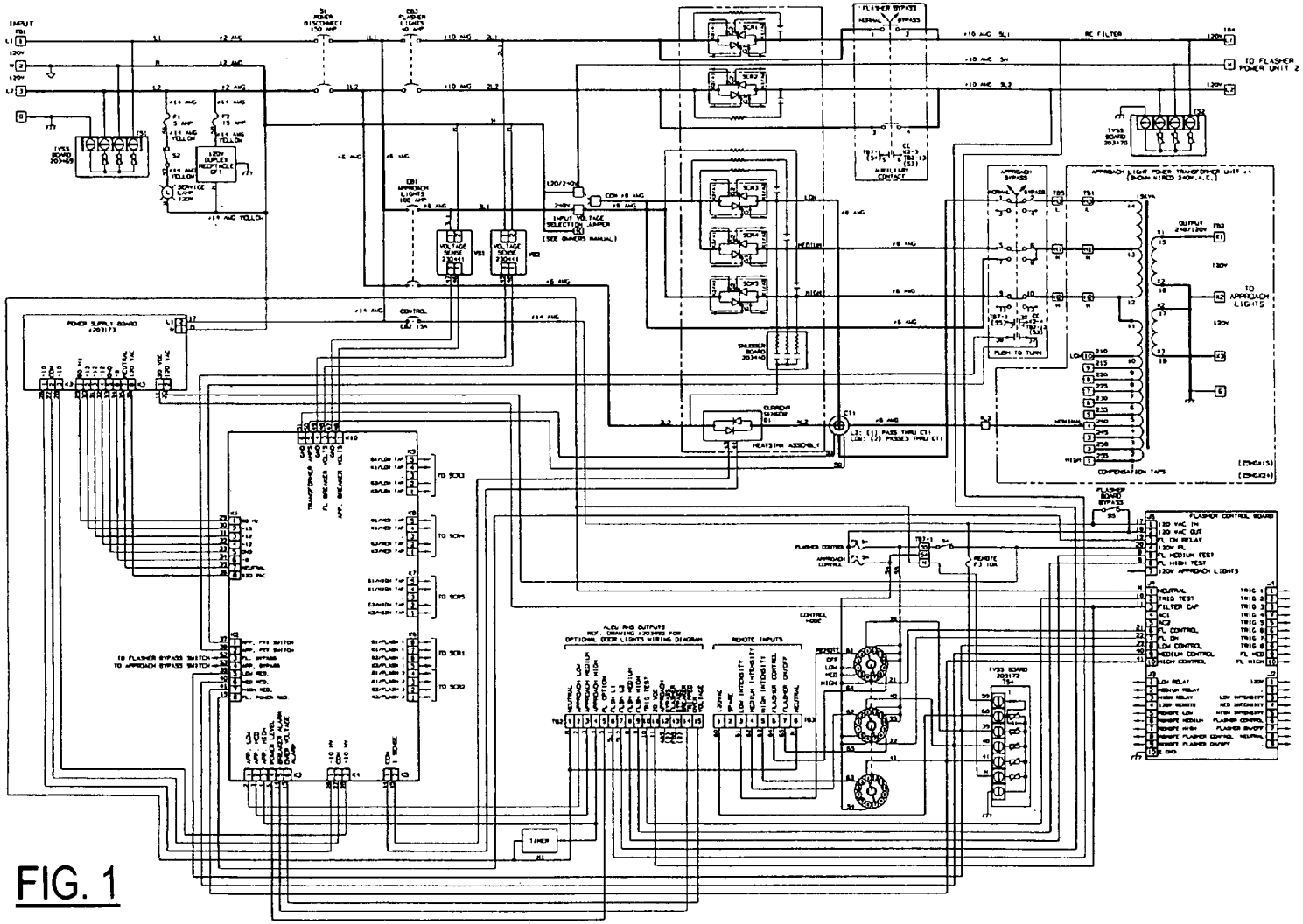
FIG. 1 is a single schematic diagram of a MALSR control system according to one embodiment of the present invention.
Figure 1A:
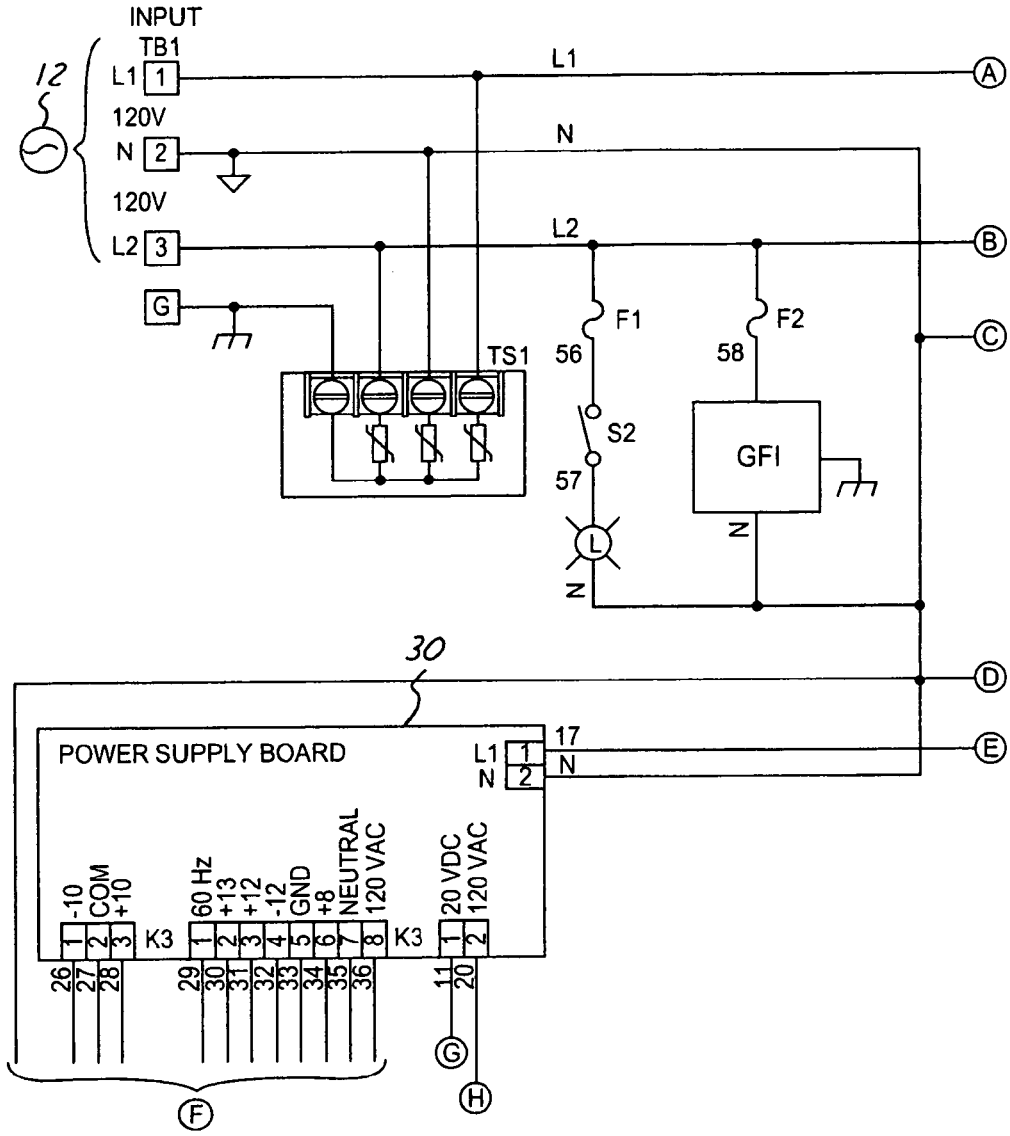
FIGS. 1A–1H collectively comprise the single schematic diagram of FIG. 1 in greater detail.
Figure 1B:
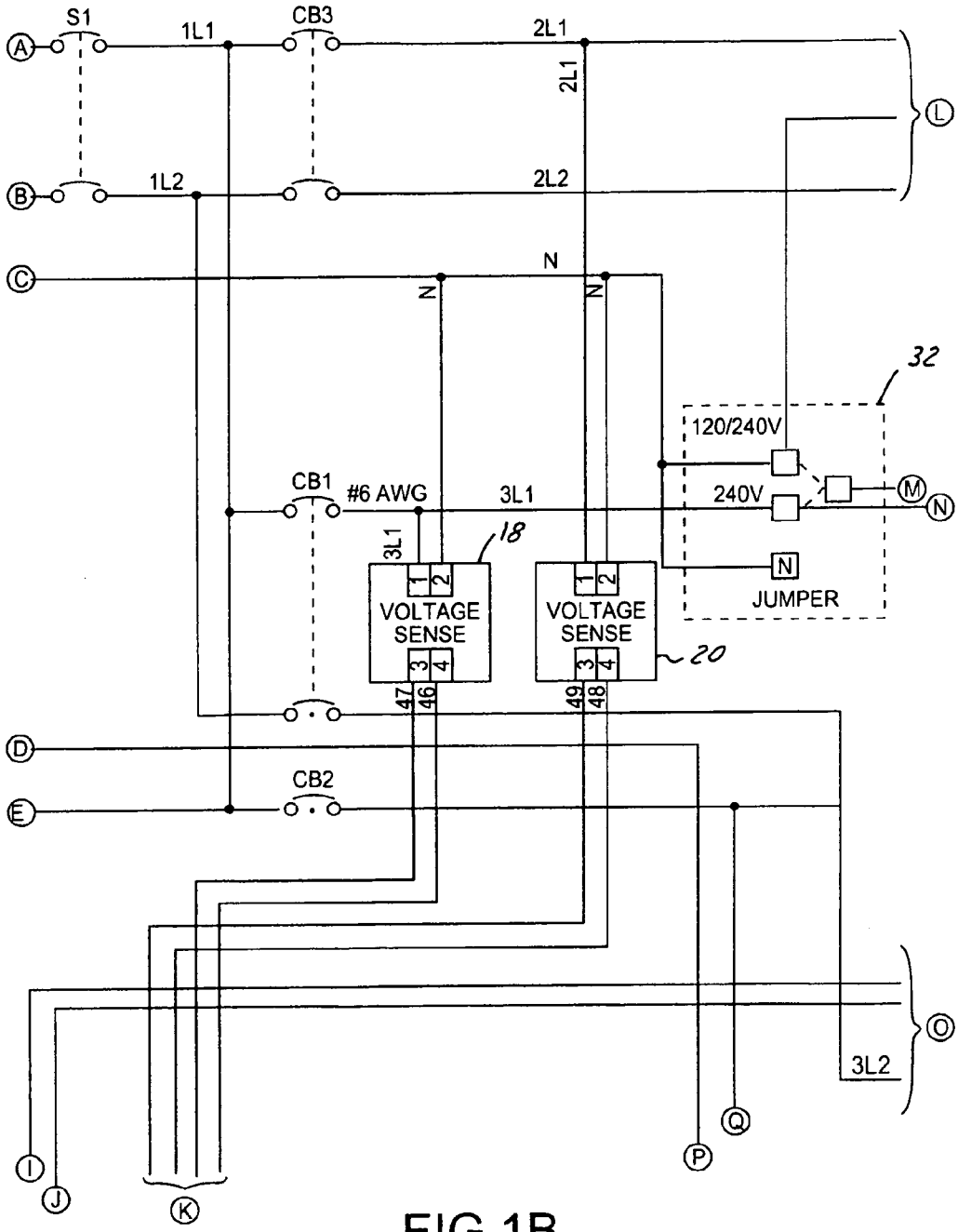
Figure 1C:
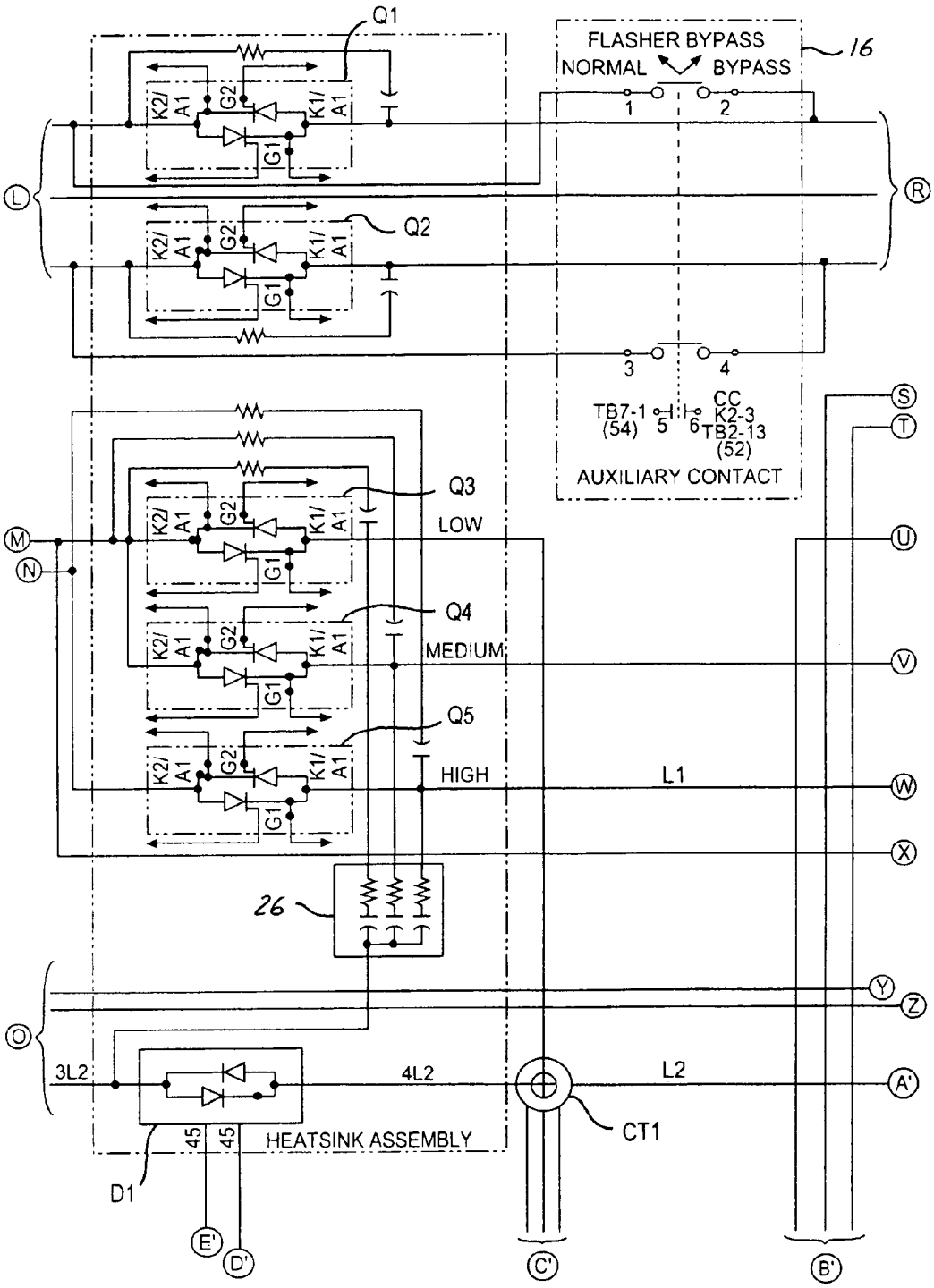
Figure 1D:
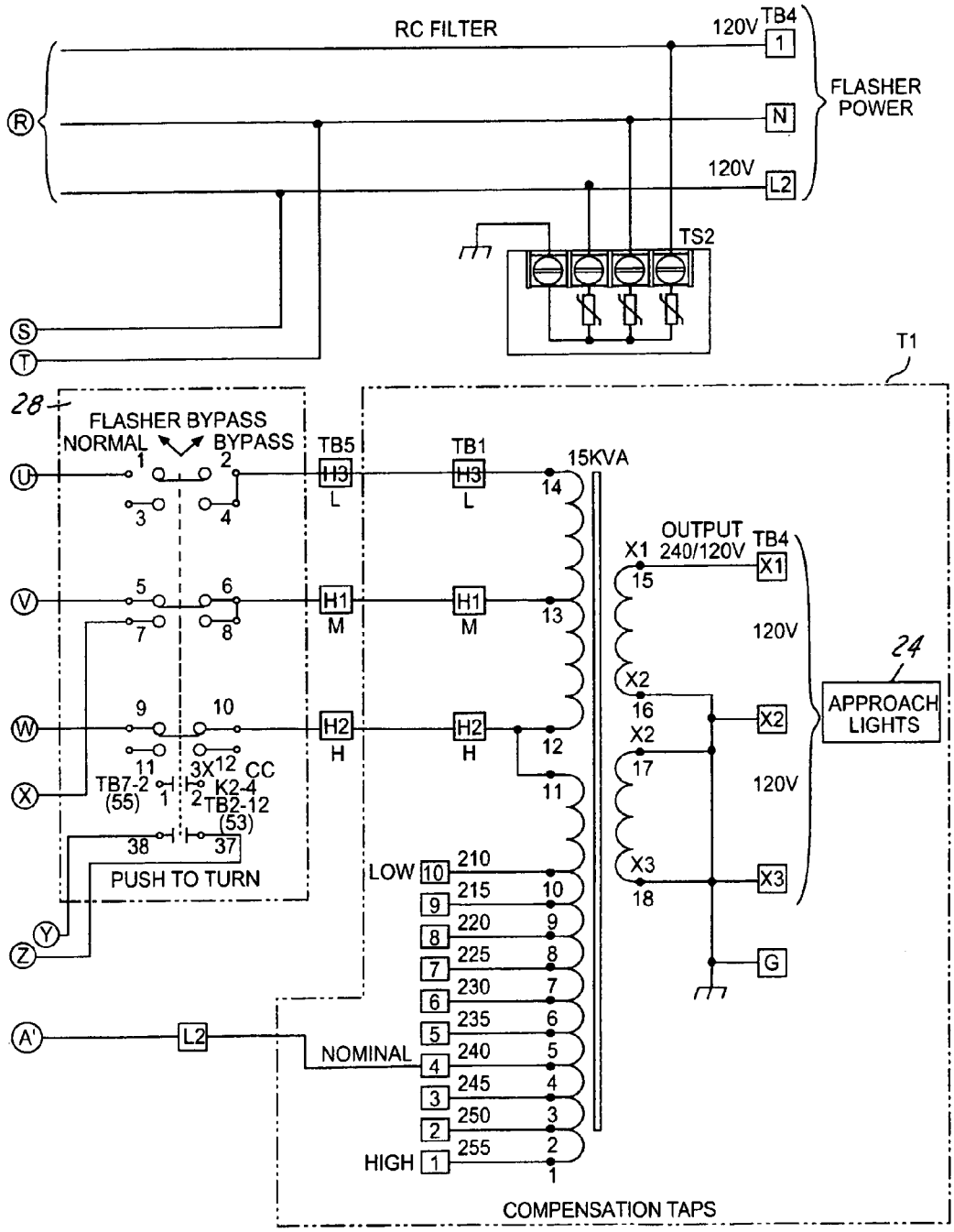
Figure 1E:
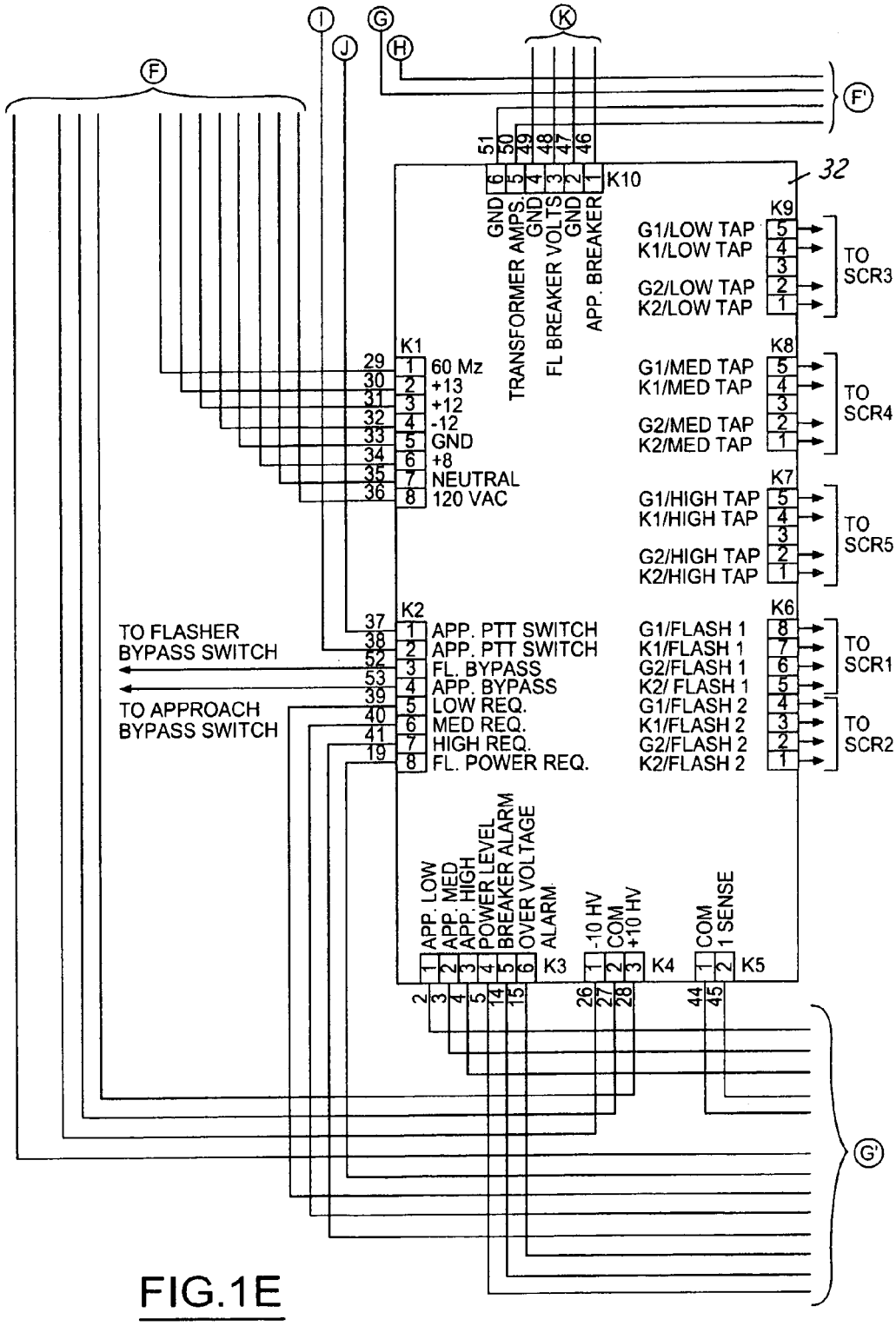
Figure 1F:
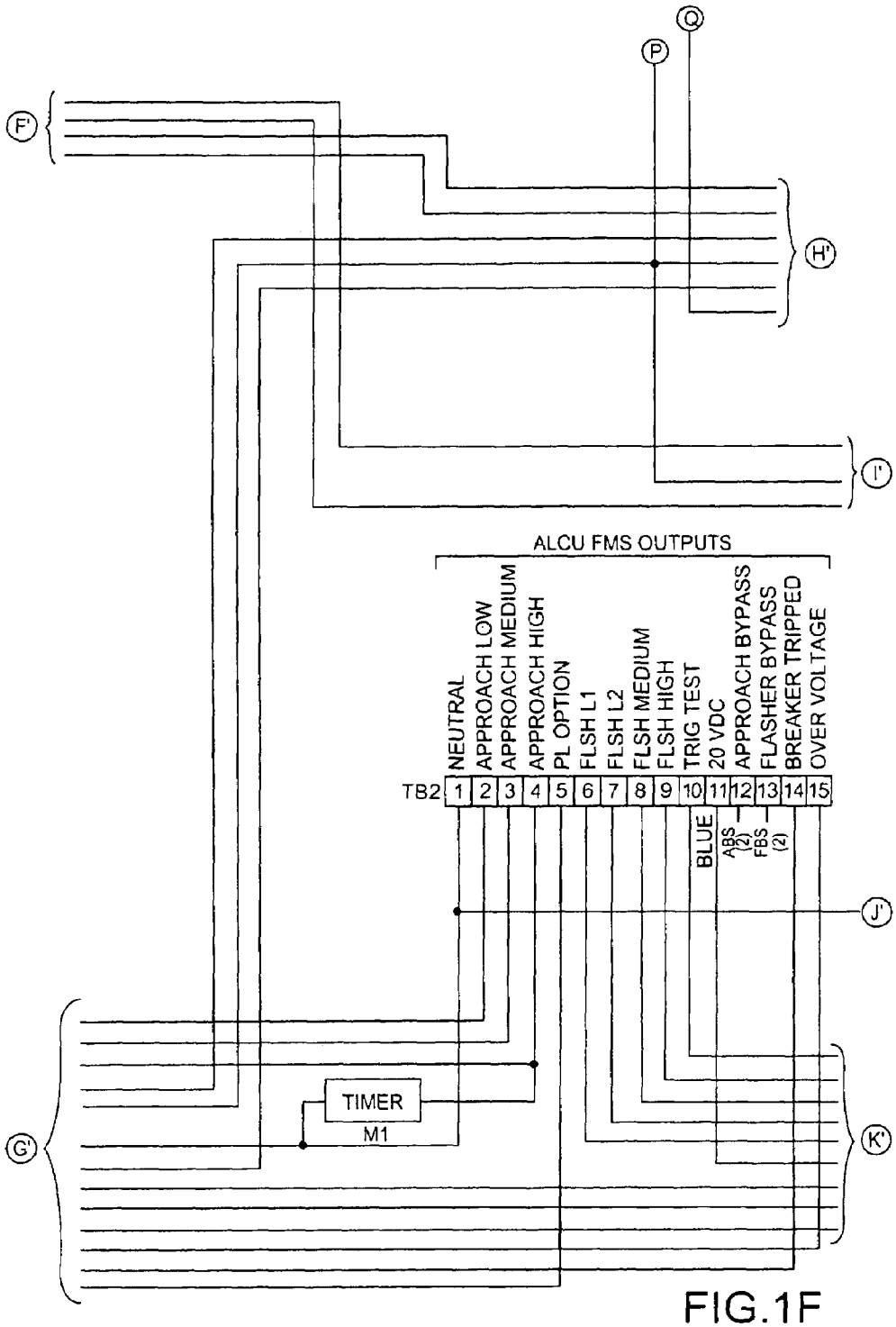
Figure 1G:
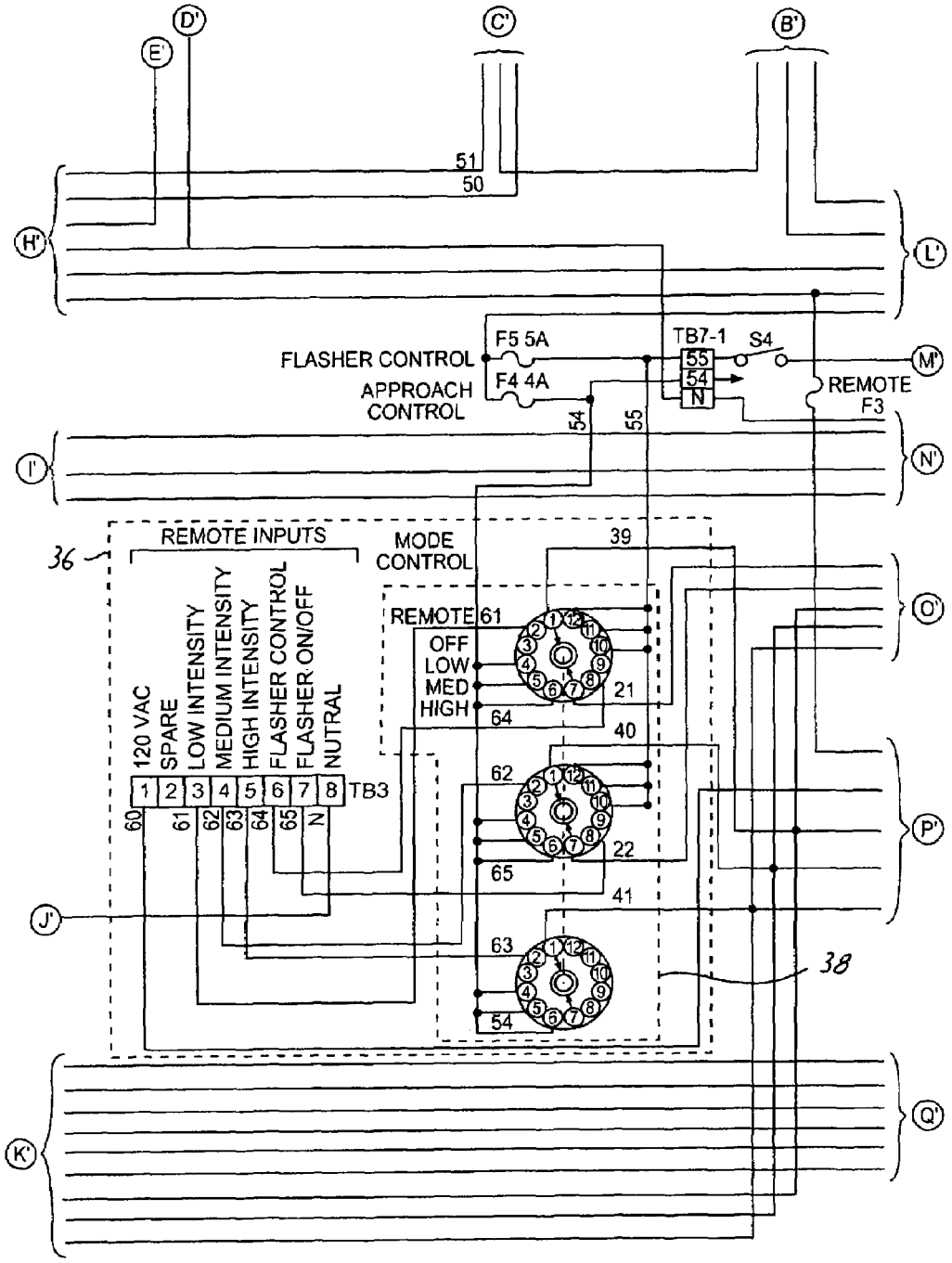
Figure 1H:
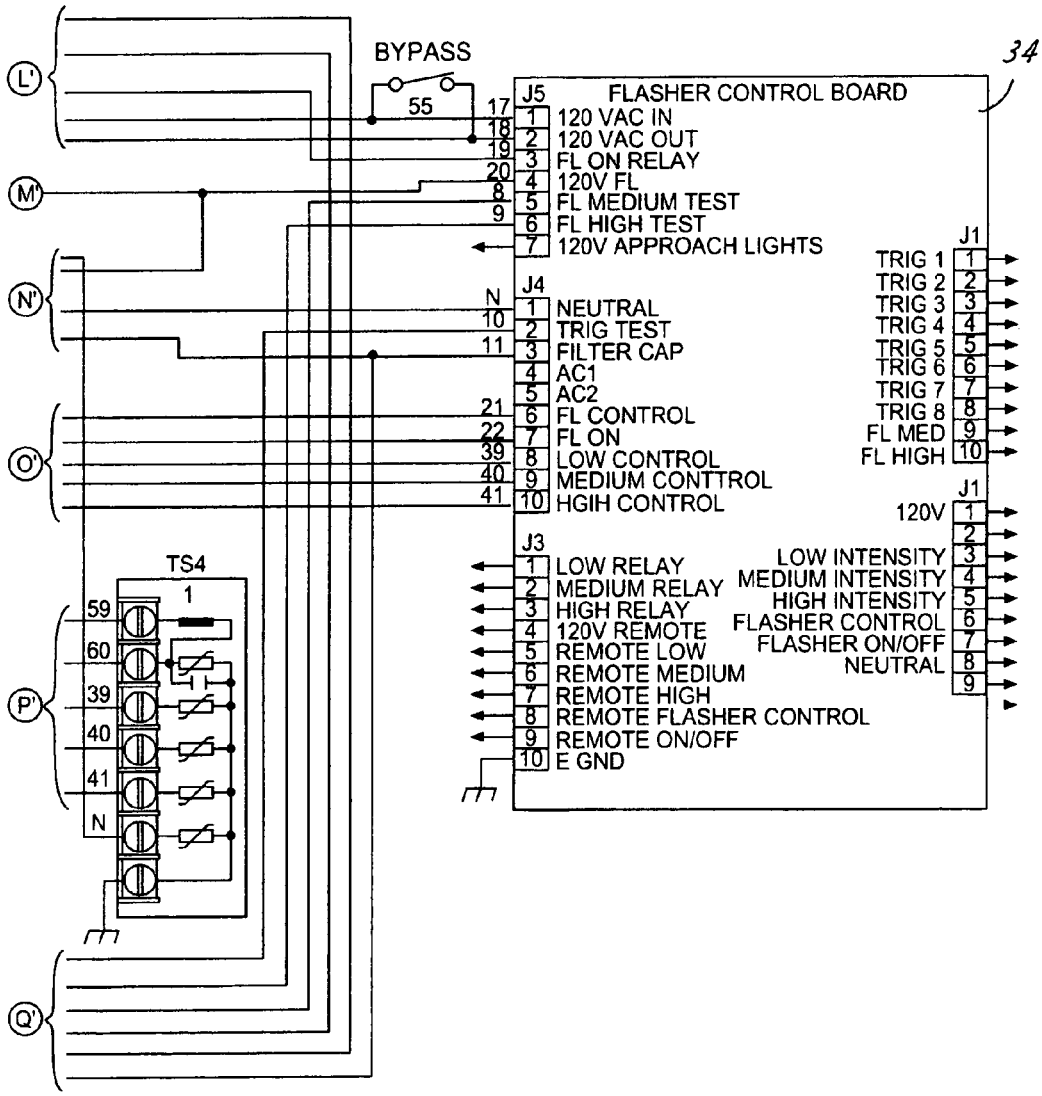

Referring in detail to the drawings, FIGS. 1–1H illustrate a schematic diagram of a portion of an aircraft landing guidance system 10 according to an embodiment of the present invention. The system 10 described herein generally provides controlling, bypassing, and power transforming for steady-burner approach lighting, and further includes interfacing to an approach light flasher system. As such, the system 10 is provided primarily for powering and controlling the operation of steady-burning approach lights, as opposed to approach flashers or approach threshold lights. In any case, the present invention also contemplates systems and methods for controlling flashers and threshold lights in the same or a similar manner as described herein with respect to the approach lights. The system 10 of FIGS. 1–1H is comprised of control circuitry and power circuitry.

In the power circuitry portion of the system 10, a power source 12 provides a supply of 120/240 or 240 Volt, 60 Hertz power, and is connected to a flasher array 14 via a line L1, a line L2, and a line N. The power source 12 is also connected to a primary side of an approach light power transformer T1 via power input lines L1, L2, and N. Line L1 and line N are controlled power lines, which are respectively connected to high, and low and medium taps of the transformer primary. Line L2 is a common power line, which is connected to a nominal tap of compensation taps of the transformer primary. A 150 amp power disconnect S1 is provided between the power source 12 and both of the transformer T1 and the flasher array 14.

In a flasher portion of the power circuitry, a 40 amp circuit breaker CB1 is provided downstream of the disconnect S1. The flasher portion further includes a first switch Q1 in line L1 and a second switch Q2 in line L2, both of which are provided for on-off switching of power that is supplied from the power source 12 to the flasher array 14, as will be described further herein below with respect to the control circuitry. Downstream of the switches Q1, Q2, a manual flasher-control bypass switch 16 is provided to disconnect the flasher array 14 from the switches Q1, Q2 and thereby provide a direct supply of power from the power-source 12 to the flasher array 14. In this way, the flashers can be powered until the system can be diagnosed in the event of control module malfunction.

In an approach light portion of the circuit, downstream of the power disconnect S1, a 100 amp circuit breaker CB1 is provided in L1 and L2. Just downstream of the circuit breaker CB1, a voltage sensor 18 is provided in communication with line N and line L1 for purposes that will be described in more detail herein below. A similar voltage sensor 20 is provided in communication with line N and line L1 in the flasher portion of the circuit for a similar purpose. Downstream of the voltage sensors 18, 20 an input voltage selection jumper 22 is provided to accommodate use of either a 240V/120V transformer T1 as shown or, alternatively, a 240V transformer.

A plurality of switches Q3, Q4, Q5 is provided for changing taps on the transformer T1 to effectuate changes in the approach light operational modes between low, medium, and high intensities. The plurality of switches includes a low tap switch Q3, a medium tap switch Q4, and a high tap switch Q5. The switches Q3, Q4, Q5 are controlled in a manner that will be described in further detail below with respect to the control circuitry. Although the switches Q3, Q4, Q5 may be of any suitable construction, they are preferably discrete, solid-state, inverse-parallel, silicon-controlled-rectifiers (SCR's). The SCR's of the present invention may be any suitable semiconductor device but are preferably a Semikron® SKKT 91/12 or SKKT 250/12 from Semikron International of Nurnberg, Germany, or a eupec® TT92N1200K or TT250N12K available from eupec Company of Warstein, Germany. Although less desirable, the present invention also contemplates use of mechanical contactor switches or other solid-state devices such as Crydom® relays. Crydom relays typically include solid-state switches, but also include gating mechanisms, RC circuitry, and snubber circuitry, and are typically of relatively lower capacity, rated in the 1,000 Volt/100 Amp range with a typical surge rating on the order of about 1,000 Amps for about ¼ of a cycle. In contrast, however, a discrete SCR is a stand-alone device of relatively higher capacity, rated in the 1,600 Volt/250+ Amp range with a surge rating on the order of about 8,000 Amps for about ½ of a cycle. In other words, the discrete SCR provides a more robust and reliable switching mechanism for the high surges and swings in power that are present in a MALSR.

Figure 5:
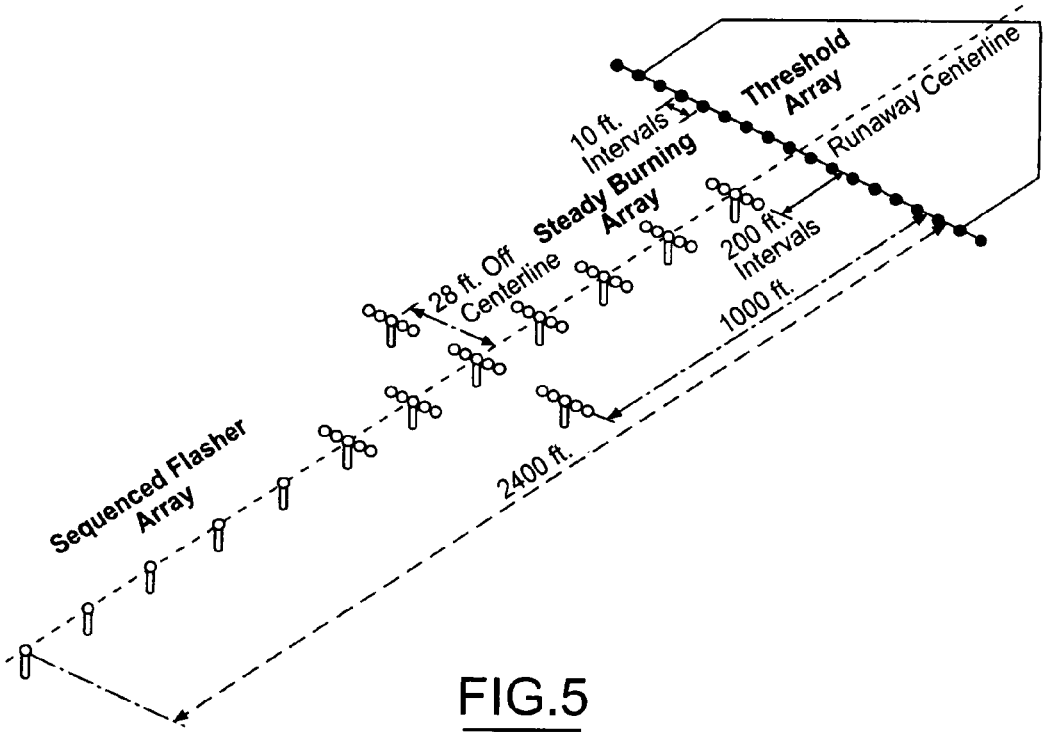
FIG. 5 is a perspective view of a runway approach area equipped with approach lights

Low tap switch Q3 is provided in a "low" line or branch of line N and, when closed, enables a first or low voltage input to the transformer T1 to operate a plurality of approach lights 24 in a first or low intensity state. The approach lights 24 may be approach lights, light-emitting-diodes, or the like. The approach lights 24 are connected to a secondary side of the transformer T1 and are operable in accordance with a plurality of intensity states including an off state and at least three on states including a low state, a medium state, and a high state. The various on states represent different power levels of the plurality of lights 24 and correspond in kind to the low, medium, and high taps on the transformer primary. The lights 24 are the approach lights, but may also be the flashers or threshold lights such as those shown in FIG. 5. The low voltage is, for example, on the order of 75 Volts to provide about 400 to 720 Candela in the approach lights. Medium tap switch Q4 is provided in a "medium" branch of line N and, when closed, enables a second or medium voltage input to the transformer T1 to operate the approach lights 24 in a medium intensity mode. The medium voltage is, for example, on the order of 150 Volts to provide about 2,000 to 3,600 Candela in the approach lights. High tap switch Q5 is provided in a "high" line, line L1. And, when closed, switch Q5 enables a third or "high" voltage input to the transformer T1 to operate the approach lights 24 in a high intensity mode. The high voltage is, for example, on the order of 240 Volts to provide about 10,000 to 18,000 Candela in the approach lights. The low, medium, and high lines connect respectively to the low, medium, and high taps of the transformer T1. The switches Q3, Q4, Q5 are protected by separate RC circuitry across each switch and a separate snubber board 26, such as a model 203440 from Controlled Power Company, that is connected to line L2 and to line L1 and each branch of line N downstream of the switches Q3, Q4, Q5.

A first power sensor D1 is provided in line L2 to enable zero-cross switching of the SCR's, which will be described in detail herein below with reference to the control circuitry. The sensor D1 may be a current transformer or hall-effect transducer, but is preferably a back-to-back diode arrangement for fast and reliable current sensing. For example, the following diodes may be used: Semikron® SKKD260/12, eupec® DD260N12K, or International Rectifier IRKD320/12. In other words, the sensor D1 is comprised of two diodes connected in inverse parallel, wherein the sensor D1 is connected in series in the common line L2 of the transformer T1 primary.

A second load or power sensor CT1 is provided downstream of the first sensor D1 in line L2 with the low branch of line N passing therethrough. The second sensor CT1 is preferably a current transformer and is used to detect power draw through the system for use in load calculations that will be described further herein below with respect to the control circuitry. For example, the following devices may be used: WICC D100-05-L24-03 or WICC D075-05-L24-03 available from W.I.C.C., Ltd. of Washington, Ill.

An approach-light-control bypass switch 28 is connected to lines L1, N, and L2 downstream of the switches Q3, Q4, Q5 to disconnect the transformer T1 from the low, medium, and high switching of power from the power source 12 and thereby provide a direct supply of power to the approach lights 24. As shown here, when the bypass switch 28 is activated, the input lines of line N and line L1 are opened or disconnected from the transformer T1, and a separate control-bypass line is closed, or connected to the transformer T1, to default the approach lights 24 to their medium intensity mode. Alternatively, the bypass switch 28 could be wired to default the approach lights 24 to the low or high modes if desired. In any case, the bypass switch 28 enables immediate return-to-service of one of the intensity modes of the system until the system can be diagnosed and repaired.

Finally, as is well known in the art, transient voltage surge suppressors (TVSS) TS1, TS2 are provided to protect the system 10 from the effects of lightning strikes.

Turning now to the control circuitry of the system 10, and still referring to FIGS. 1–1H, a power supply board 30 is connected to lines L1, and N, and generates isolated direct current levels required for 120 VAC and DC operation of an approach light control board or control module 32 and 20 VDC operation to a flasher control board 34.

The flasher control board 34 is provided to handshake the approach light controls and input controls to the flasher array. It should be noted that the present invention is capable of operating independently of the flasher control board 34 if desired.

The control module 32 receives power inputs from the power supply 30 as depicted by wire numbers 26–36. Also, the control module 32 receives sensed voltage inputs from the voltage sensors 18, 20, and receives sensed current inputs/input voltages from the current sensor CT1, as depicted by wire numbers 46–51. Additionally, the control module receives sensed current input from the current sensor D1 as depicted by wire numbers 44–45. Moreover, the control module 32 communicates with the bypass switches 16, 28; receiving a push-to-turn signal from the approach-light-control bypass switch 28 as depicted by wire numbers 37–38, and receiving flasher and approach-light-control bypass switch signals as depicted by wires 52 and 53 respectively. Finally, the control module 32 receives flasher power request inputs from the flasher control board 34 as depicted by wire number 19 and also receives approach light intensity mode request inputs from an input source or input control portion 36 of the system as depicted by wire numbers 39–41. The input control portion 36 is provided to accept lighting intensity requests including off, low, medium, and high intensity requests for operation of the approach lights in their off, low, medium, and high states. The input control portion 36 is capable of receiving and communicating a request for an increase or decrease in lighting intensity from one of the approach light states to another. The input control portion 36 may include a bank of manual selector switches 38 for manually selecting among the various modes and may also include hardwired or wireless remote inputs received from a remote source such as a control tower or an approaching aircraft, as is well known to those of ordinary skill in the art. A TVSS TS4 is connected with the input control portion 36 for protection thereof.

The control module 32 provides various outputs including power on/off switch commands to the flasher switches Q1, Q2 as depicted by port K6 on the control module. Primarily, however, the control module provides low, medium, and high lighting intensity commands to the approach light switches Q3, Q4, Q5 as depicted by ports K7–K9 on the control module. Finally, the control module provides output signals, as depicted by wire numbers 2–5, 14, 15 at port K3 on the control module, such as to an electrical cabinet door light array and/or to a wireless transmitter that can provide system status feedback to a control tower.

Referring to FIGS. 1, 1F, and 1J, an optional tower lamp and driver can be provided wherein a single auxiliary lamp is pointed at a control tower for visual feedback that at least one of the intensity modes is operational. Terminals 2–4 of strip TB2 are connected to an input side of a tower lamp driver (not shown) such as a circuit, logic chip, or the like, wherein the signals are subjected to an OR function. One contact of an auxiliary lamp (not shown) is powered by terminal 1 of strip TB3, and another contact of the auxiliary lamp is tied common to an output line of the tower lamp driver via spare terminal 2 of strip TB3. The tower lamp driver is tied to neutral terminal 8 of TB3. Accordingly, when any intensity mode is operational, the 120v auxiliary lamp will light up to indicate that the light field is actually being powered.

Figure 2:
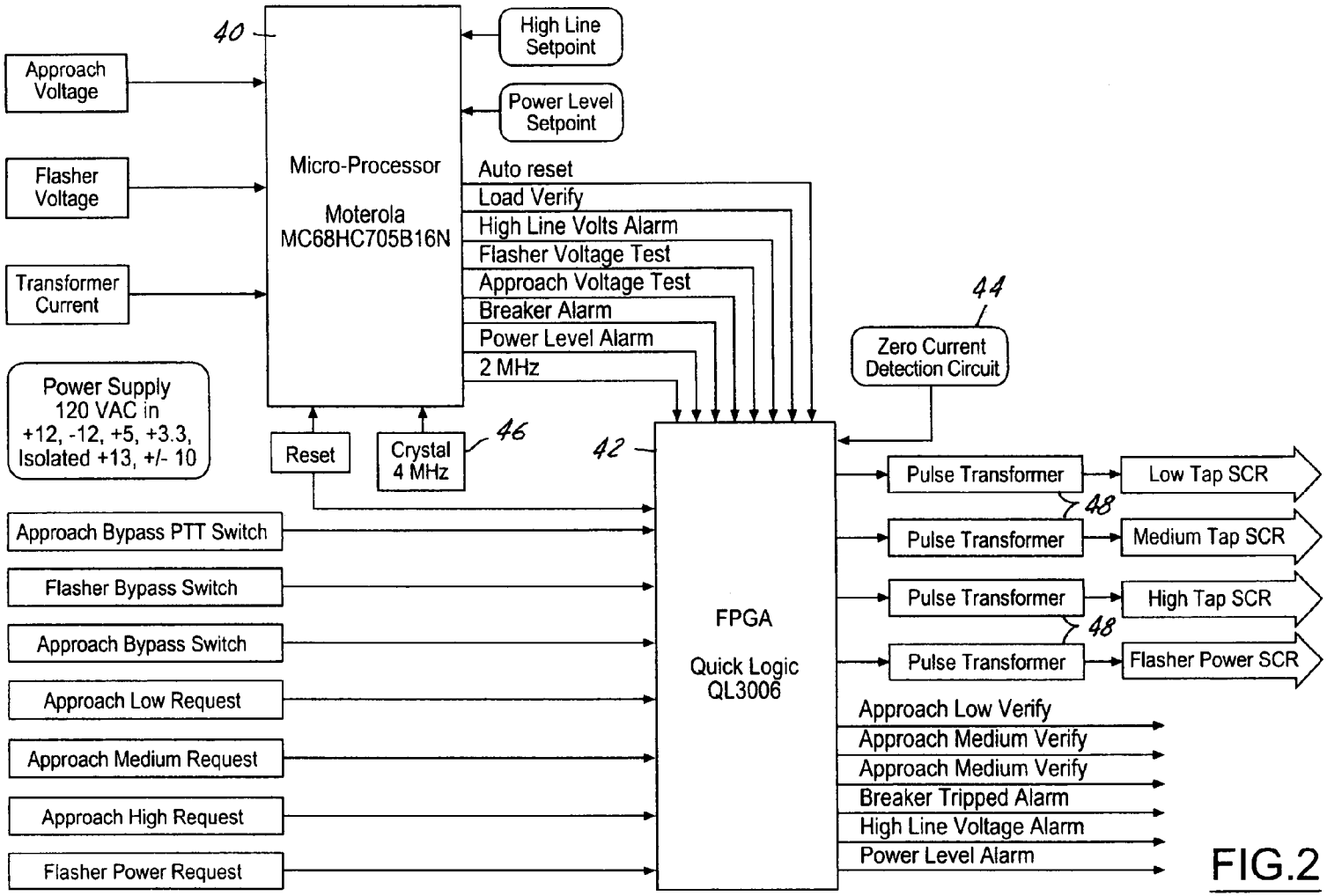
FIG. 2 is a block diagram of a control module of the MALSR control system of FIGS. 1A–1C.

FIG. 2 illustrates a block diagram of the control module 32. As is typical, the control module 32 may include memory (not shown) and interface electronics (not shown) in addition to a controller 40. The interface electronics may conform to protocols such as RS-232, parallel, small computer system interface, and universal serial bus, etc. The controller 40 may be interfaced with memory, such as RAM, ROM, EPROM, and the like, that is configured to provide storage of computer software that provides the functionality of the system and that may be executed by the controller. The memory may also be configured to provide a temporary storage area for data received by the system from various system sensors or from a host device, such as a computer, server, workstation, and the like. The controller 40 may be configured to provide control logic that provides the functionality for the system or a separate device may be coupled to the controller 40 to provide control logic such as a field-programmable-gate-array (FPGA) 42. In this respect, the controller 40 may encompass a microprocessor, a microcontroller, an application specific integrated circuit, and the like. Preferably, the control module 32 includes a Motorola® MC68HC705B16N microprocessor 40 that provides output to a QuickLogic® QL3006 FPGA 42.

The method of the present invention may be performed as a computer program and various setpoints and the like may be stored in memory as a look-up table or the like. The computer program may exist in a variety of forms both active and inactive. For example, the computer program can exist as a software program comprised of program instructions in source code, object code, executable code or other formats; a firmware program; hardware description language (HDL) files; or the like. Any of the above can be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), and magnetic or optical disks or tapes. It is therefore to be understood that the method of the present invention may be performed by any electronic device capable of executing the above-described functions.

Figure 3A:
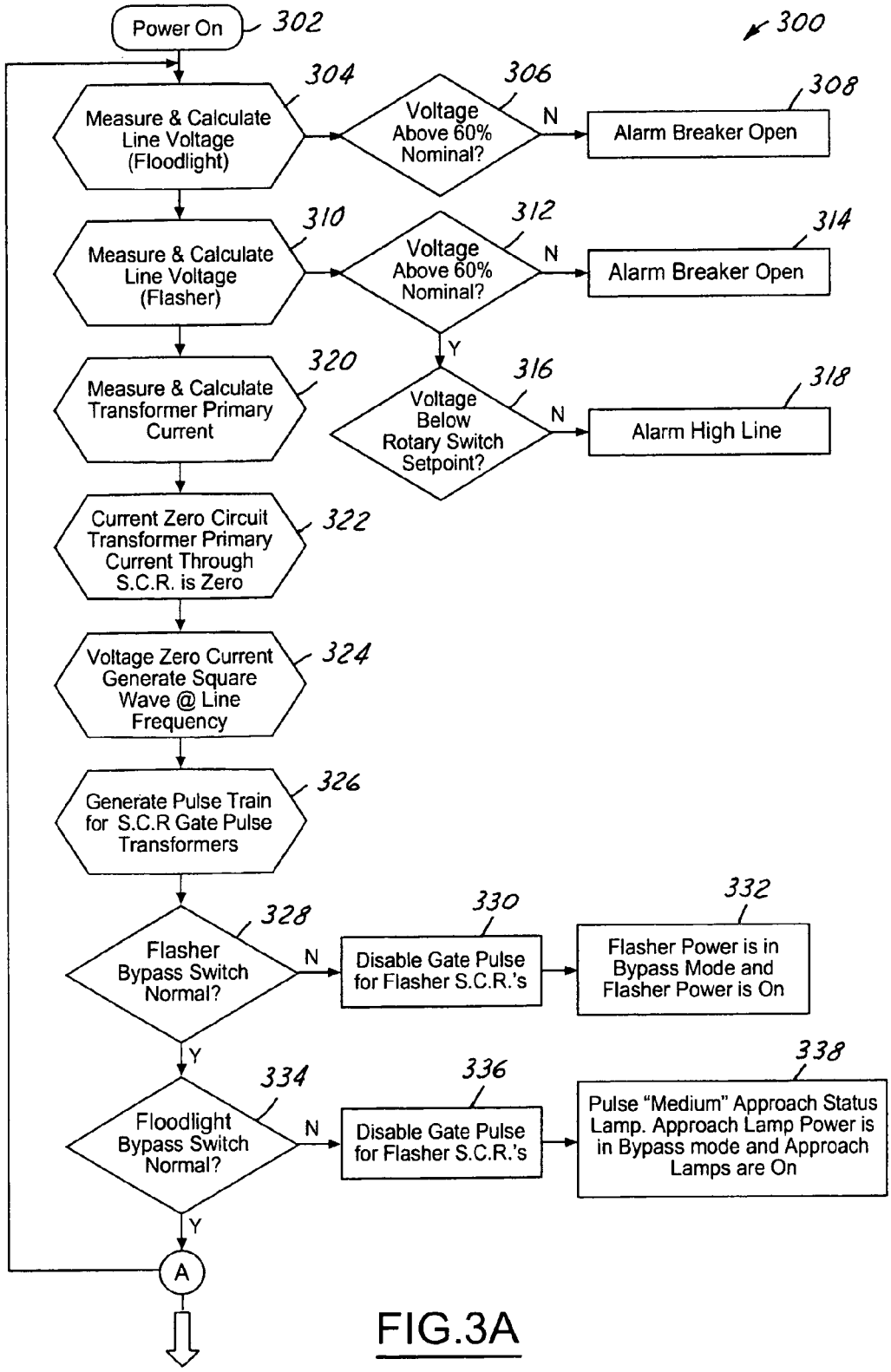
FIGS. 3A and 3B, when joined together, comprises a single flow chart of an exemplary process that is carried out by the control module of FIG. 2.
Figure 3B:
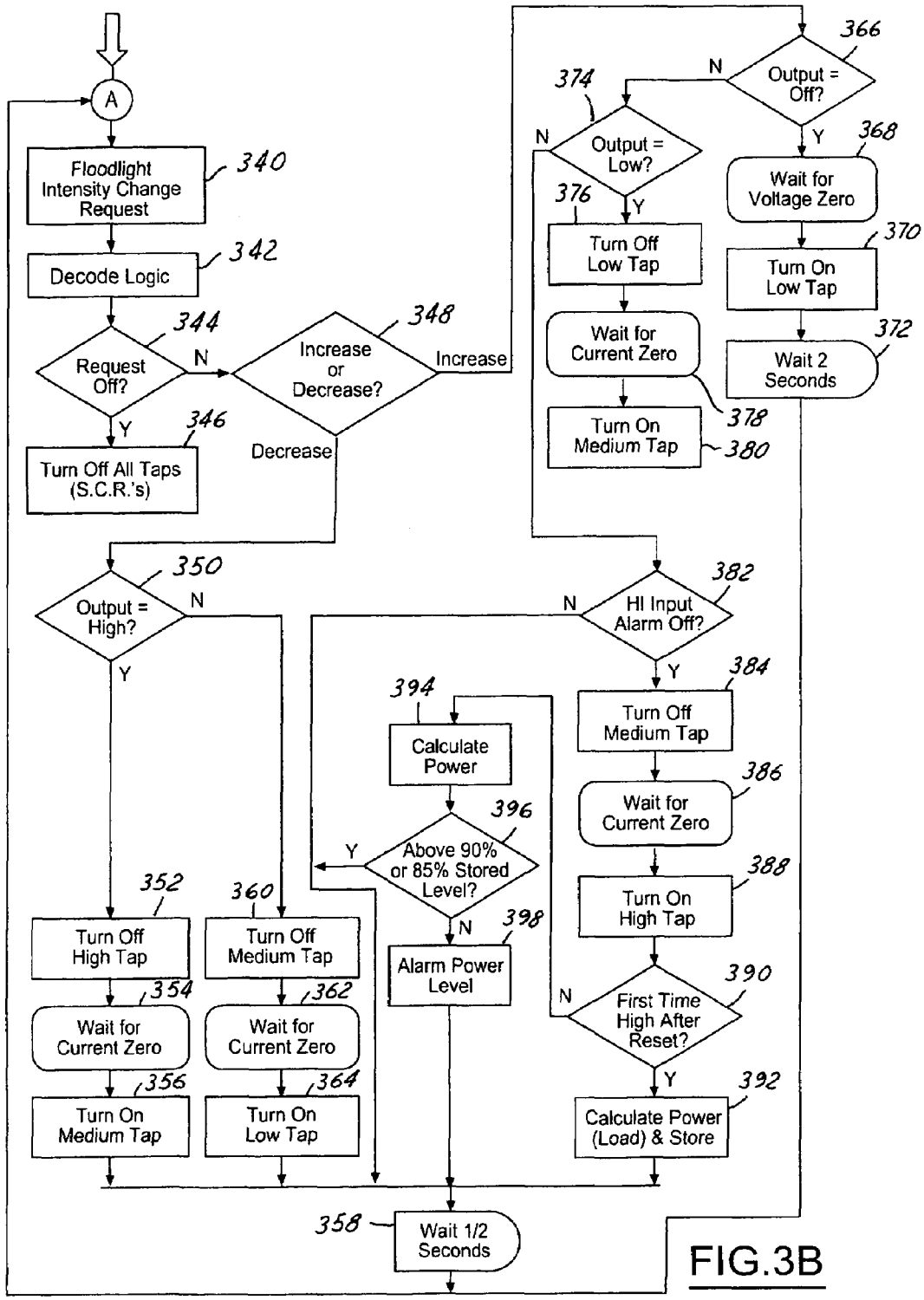

Operation of the microprocessor 40 and FPGA 42 is best described with simultaneous reference to the system schematic of FIGS. 1–1H and to the algorithms loaded to or embedded therein and depicted by FIGS. 3A and 3B.

FIGS. 3A and 3B depict the algorithms or process 300 used by the microprocessor 40 and FPGA 42 of FIG. 2. FIG. 3A, in particular, is a flow chart that primarily depicts the operation of the microprocessor 40. After a power-on step 302, the microprocessor reads voltages and current in the power circuitry of the system of FIGS. 1–1H. The microprocessor 40 is isolated from the voltage and current inputs from the power circuitry of the system 10 by any suitable isolators, but is preferably isolated by opto-isolators or couplers and isolation transformers (not shown). Any suitable opto-coupler may be used such as HCPL-3700 available from the Hewlett-Packard Company, or the like. The microprocessor 40 reads voltages sensed by the voltage sensors 18, 20 of the system 10 of FIGS. 1–1H. In particular, at step 304, the microprocessor measures and calculates the actual approach light line voltage. At step 306 the actual approach light line voltage is compared to a predetermined high line voltage setpoint such as 60% of nominal line voltage. If the actual approach light line voltage is not above the predetermined setpoint, then the microprocessor 40 outputs a breaker-open alarm through the FPGA 42, shown as step 308. At step 310, the microprocessor measures and calculates the actual flasher line voltage. At step 312 the actual flasher line voltage is compared to a predetermined high line voltage setpoint such as 60% of nominal line voltage. If the actual flasher line voltage is not above the predetermined setpoint, then the microprocessor 40 outputs a breaker-open alarm through the FPGA 42, shown as step 314.

At step 316, the voltage is compared to a rotary switch setpoint. If the actual line voltage is greater than the predetermined rotary switch setpoint, then the microprocessor 40 outputs a high line voltage alarm through the FPGA 42, as depicted by step 318.

Still referring to FIG. 3A, the process 300 advances to step 320 wherein the microprocessor measures and calculates current flowing to the primary side of the transformer T1 of the system of FIGS. 1–1H, using the current sensed from the power sensor CT1, for purposes of monitoring load or power drawn by the approach lights.

Figure 2A:
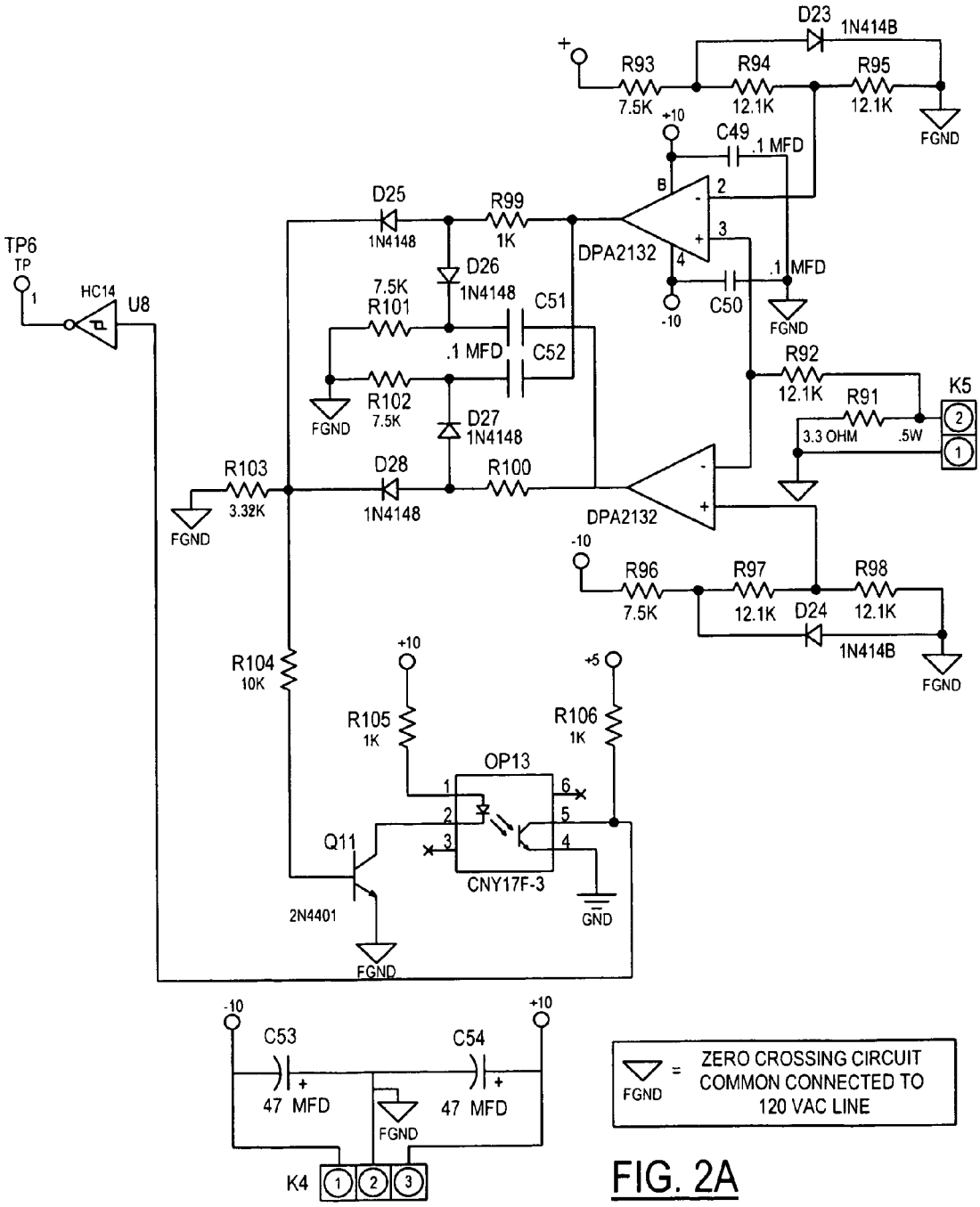
FIG. 2A is a schematic of a zero-cross circuit depicted in block diagram form in FIG. 2.

At step 322, the power flow through a presently closed, or "ON", subject switch of the plurality of switches Q3, Q4, Q5 of the system of FIGS. 1–1H is inferred by a voltage drop across the current sensor D1. This step is carried out by a zero-amperage current detection circuit 44 as depicted in the block diagram of FIG. 2. For purposes of example only, the circuit 44 may be a zero-cross detection circuit as depicted in detail in FIG. 2A. The present invention contemplates, however, that any suitable zero-cross current detection circuit may be used. This circuit 44 monitors the voltage drop across the back-to-back diode sensor D1 in line L2. If the voltage drop is less than 0.6 Volts, then it is inferred that the current flow through the subject switch has fallen to nearly zero Amps. If the current maintains at this level, then the subject presently-closed switch will open or revert to its "OFF" state. By detecting and measuring the duration that the current flow is in this state, it is possible to ensure that the subject switch is in its OFF state and that it is safe to activate, or turn ON, another of the plurality of switches Q3, Q4, Q5 without damaging the system 10. The present invention contemplates that the power sensors D1 and CT1 can also operate as or be characterized as voltage or current sensors.

At step 324, the microprocessor 40 generates a square wave at line frequency with input pulses received from a four MHz crystal clock 46.

At step 326, the microprocessor 40 generates a pulse train of 15–18 Volt pulses from a four MHz crystal clock 46 that is capable of firing the SCR's. The pulse train is derived from the crystal clock 46 and has a frequency of 7.8 kHz and a duty cycle of about 16 μsec ON and about 112 μsec OFF. Speed-up pulses assure faster turn on of the SCR's, and are provided at voltage zero, current zero, and initial turn-on of any given subject switch, in which case the duty cycle of the pulse train is changed to about 16 μsec ON and about 64 μsec OFF. Any suitable duration of the speed-up pulses may be selected, but is preferably 500 μsec.

At step 328, the microprocessor 40 monitors the flasher-control bypass switch 16 of the system 10 of FIGS. 1–11H. If the state of the switch 16 is not normal (i.e. L1, L2 contacts closed), then the microprocessor 40 disables gate pulses for the flasher switches Q1, Q2 at step 330. As depicted by step 332, the microprocessor 40 then sends output signals to indicate that the flasher circuit is in bypass mode and that flasher power is in an ON state.

At step 334, the microprocessor 40 monitors the approach-light-control bypass switch 28 of the system 10 of FIGS. 1–1H. If the state of the switch 28 is not normal (i.e. L1, N, L2 contacts closed), then the microprocessor 40 disables gate pulses for the approach light switches Q3, Q4, Q5 at step 336. As depicted by step 338, the microprocessor 40 then sends output signals to indicate that the approach light circuit is in bypass mode and that the approach lights are in an ON state.

Referring now to FIG. 3B, there is depicted a continuation of the flow chart of FIG. 3A that primarily depicts the operation of the FPGA 42, which commands forced approach light intensity changes based on requested intensity change requests. As an overview, approach light intensity changes are performed in a forced sequential manner. This may also be referred to as forced "staircasing", "staircase switching", or progressive intensity changing. In any case, when an input request calls for an increase in intensity from an approach light OFF mode, the low tap switch Q3 is gated ON for a period of approximately two seconds, regardless of the actual level of intensity requested. This allows the approach light lamps an opportunity to "warm up" before being fully powered by activation of the high tap switch, thereby extending the life of the approach light lamps. At this point, if the request received was for the low intensity setting, then the control module 32 just returns to a system monitoring state. If however, the request received was for a higher intensity setting (i.e. medium or high), then the low tap switch Q3 is deactivated after a predetermined warm-up delay and the medium tap switch Q4 is activated immediately thereafter so as to avoid interruption of the current through the primary of the transformer T1. The predetermined warm-up delay is preferably approximately two seconds but may be less or more if desired. If the request received was for the medium intensity setting, then the control module 32 just returns to a system monitoring state. If, however, the request received was for the high intensity setting, then the medium tap switch Q4 is gated for a predetermined delay period (e.g. about ½ of a second) before it is deactivated and the high tap switch Q5 is activated immediately thereafter so as to avoid interruption of the current through the primary of the transformer T1. In other words, the off-on gating of adjacent switches is carried out in a synchronous manner with predetermined delays therebetween to avoid high transformer excitation currents while enabling substantially continuous power flow. This process of progressive or sequential switching is provided to reduce in-rush of current through the primary of the transformer T1 when a "higher" (medium or high) voltage is applied through an adjacent "higher" (medium or high) tap switch to the transformer T1. In other words, with the built-in predetermined delays and by progressively activating the low tap switch, then the medium tap switch, and finally the high tap switch, the in-rush current is reduced by reducing the differentials in the amplitude of the applied voltage and/or current.

Figure 4A:
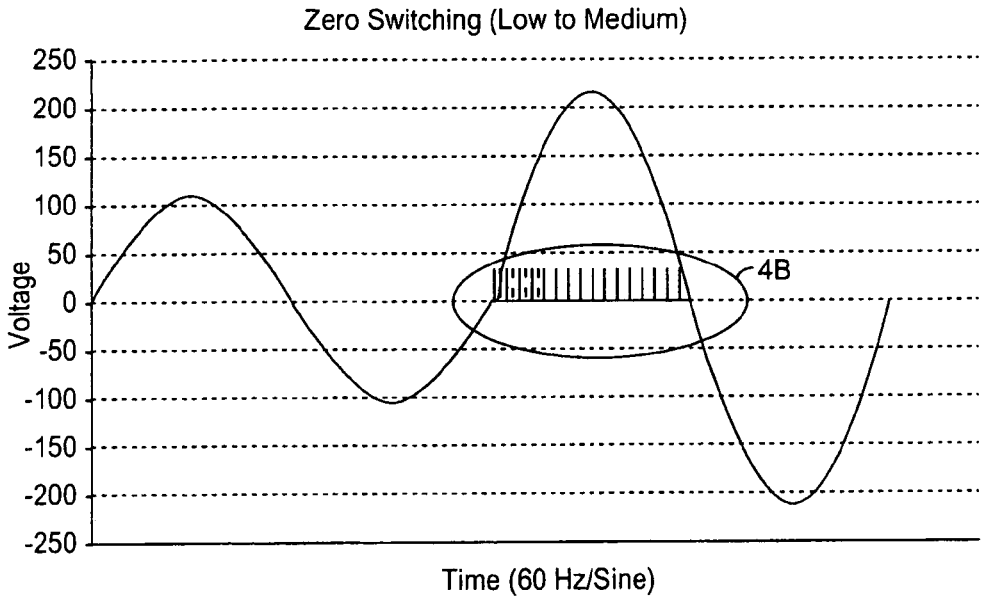
FIGS. 4A and 4B are graphical representations of a sine wave of system power and of a pulse train generated by the control module of FIG. 2 in accordance with the process steps of FIGS. 3A and 3B.

The forced sequential switching of the present invention can be visualized using a sine wave plot of alternating current or voltage, such as that depicted in FIG. 4A. The power received from the utility company or on-site generator is alternating current (AC) power that swings positive and negative in a sine wave in sinusoidal cycles sixty times per second (60 Hz). In each sinusoidal cycle, the power departs from a "positive" region above a zero power threshold and enters a "negative" region below the zero power threshold.

At the instant that the sine wave "crosses" the zero power threshold, no power is present in the line. Thus, the instantaneous value of power automatically becomes zero twice in each cycle. For a brief period of time after the zero crossing, the power remains so low as to be negligible or substantially absent. It is during this timeframe that the control logic interprets the input request signals, eliminates any switching overlap or discontinuity, and initiates a controlled switching routine that assures staircased increases in intensity from a low tap start-up. Power level transitions between switches commence substantially at the natural sine commutation, wherein a presently activated switch is deactivated and the next or adjacent switch activated. Preferably, this window of time is within 300 μsec of detection of the zero crossing, which translates into less than about 7 degrees of a 360 degree sine wave at 60 Hz. In other words, the present switch is deactivated upon the zero-crossing of the current sine wave and, thereafter, the next switch is activated within about 300 μsec. Thus, the controller need not interrupt the power flowing through the plurality of switches to the transformer T1, but need only synchronize the deactivation of one switch and activation of an adjacent one of the switches to redirect the power flow at the zero-crossing from one switch to the other. This basically amounts to nearly seamless switching from one power level to another power level, and can also be carried out to decrease power levels as well as increase power levels.

Figure 4B:
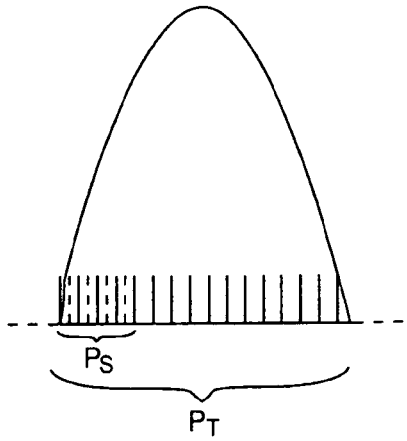

FIG. 4B illustrates a first half-cycle of a sine wave of current across the medium tap switch Q4 and the pulse train ($P_T$) generated by the microprocessor 40 and crystal clock with the speed-up pulses ($P_S$) applied at the initial activation of the switch Q4 for fast gating thereof. The speed up pulses may also be applied at every voltage zero or current zero crossing of the sine wave. The speed up pulses are generated for about 500 μsec at a time. The pulse train duty cycle is about 16 μsec ON and about 112 μsec OFF and, during the speed up cycle, is about 16 μsec ON and about 64 μsec OFF. Preferably, the FPGA 42 gates the SCR's by a logical OR of the pulse train and speed-up pulses with a power present acknowledgement, such as from the voltage sensor 18.

Figure 4C:
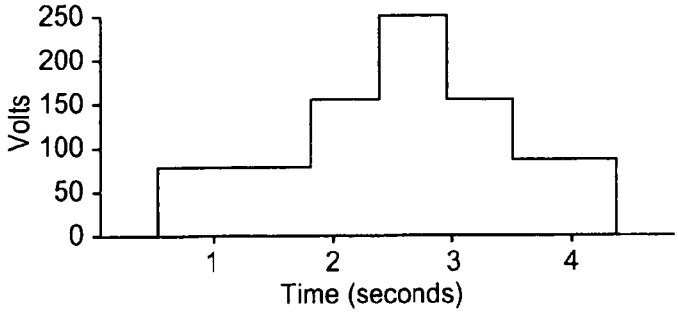
FIG. 4C is a graphical representation of an overall voltage envelope of a typical off-low-medium-high-medium-low switching sequence according to an embodiment of the present invention.

FIG. 4C illustrates an overall voltage envelope of a typical off-low-medium-high-medium-low switching sequence. The off to low switching takes approximately two seconds. Each of the low to medium and medium to high switching takes approximately 0.5 seconds. Each of the downward intensity switching from high to medium, and medium to low takes approximately 0.5 seconds.

Steps 340 through 398 represent just one example of many possible algorithms for carrying out the process described above. At step 340, the control module 32 monitors approach light intensity change requests received from the input control portion 36 of the system 10 of FIGS. 1–1H.

At step 342, binary-format requests from the input control 36 are decoded from, for example, a 011 format to a 010 format, which is compatible with the firing of SCR's.

At step 344, it is determined if an incoming request is a system OFF request. If so, then power is cut to all of the switches Q1, Q2, Q3, Q4, Q5, as depicted by step 346. As shown in FIG. 2, the FPGA 42 is linked to the switches Q1–Q5 by a bank of pulse transformers 48 that suitably insulate the control module 32 from the high power of the power circuitry. Any suitable pulse transformers may be used, such as the following transformers: Dale PT-20-205 from Vishay Intertechnology of Malvern, Pa. or model #11Z3300 from Vitec Electronics Corporation of Carlsbad, Calif.

If, at step 344, the FPGA 42 determines that the incoming request is not a system OFF request, then the FPGA 42 next determines whether the intensity change request is an increase or a decrease request at step 348. If the request is a decrease in intensity, then the process proceeds to step 350.

Next, it is determined at step 350 whether the present state of the approach lights is in the high mode. If the present state is the high intensity mode, then the power to the high tap switch Q5 is cut at step 352. Then, at step 354 the FPGA 42 waits for the alternating current to cross the zero line threshold at which point the medium tap switch Q4 is turned on at step 356. Finally, at step 358, a pause of ½ of one second is carried out to permit the transformer T1 to stabilize and the process returns to step 304.

Returning to step 350, if the present state is not the high intensity mode, then power to the medium tap switch Q4 is cut at step 360. Then, at step 362 the FPGA 42 waits for the alternating current to cross the zero line threshold at which point the low tap switch Q3 is turned on at step 364. Finally, at step 358, a pause of ½ of one second is carried out to permit the transformer T1 to stabilize and the process returns to step 304.

Returning to step 348, the FPGA 42 determines whether the intensity change request is an increase or a decrease request. If the request is an increase in intensity, then the process proceeds to step 366. The FPGA 42 next determines at step 366 whether the present state of the approach lights is OFF. If the present state of the approach lights is OFF, then the process waits for the current signal to cross a zero level at step 368. Once the current has crossed the zero threshold, the low tap switch Q3 is activated at step 370 thereby supplying low voltage to the transformer T1 primary to power the approach lights to a low intensity level. Before proceeding back to step 304, however, the process waits for a period of two seconds at step 372, which allows the approach light lamps to warm up.

Returning to step 366, if it is determined that the present state of the approach lights is not OFF, then the process advances to step 374. Here it is determined whether or not the present state of the approach lights is at the low intensity level. If the present state is low, then the low tap switch Q3 is deactivated at step 376. Thereafter, the process waits for the current to cross the zero threshold at step 378, at which instant of time the medium tap switch Q4 is activated at step 380. Again, the process then waits for ½ of a second at step 358 before returning to step 304.

Returning to step 374, if it is determined that the present state of the approach lights is not low, i.e. medium, then the process advances to step 382 wherein it is determined whether the high line voltage alarm is OFF. If the alarm is not OFF, then the process skips to the wait step 358 before returning to step 304. This step is provided to ensure that there is not an excessive level of incoming line voltage that could damage the lamps. It is estimated that this step may extend the life of the approach light lamps, perhaps by a factor of two or more. If, however, the alarm is OFF, then the process continues to step 384 wherein the medium tap switch Q4 is deactivated. At step 386, the process waits for the current signal to cross the zero threshold, at which point the high tap switch Q5 is then activated at step 388.

The final sequence of steps from 390 to 398 is provided as an inexpensive and reliable method of prolonging the life of approach light lamps. In step 390, it is determined whether this is the first time the high tap switch Q5 has been activated, e.g. since a manual reset last occurred, or if it is the first time the system has been used, or a power outage led to reset of the system. If so, the power being drawn by the approach lights is calculated using input from the current sensor CT1 and stored as a baseline load at step 392. If, however, at step 390 it is determined that this is not the first time the high tap switch Q5 has been activated since a reset, etc., then the process advances to step 394 wherein present load or power drawn by the approach lights is calculated. At step 396 it is determined whether the present load is above a predetermined percentage of the stored baseline level, such as 85% or 90%. If so, then the process simply advances to the wait step 358 before returning to step 304. If not, however, then a power level alarm signal is output to alert personnel that an unacceptable number of approach light lamps may be burned out and in need of replacement. Thereafter the process passes through step 358 and repeats at step 302.

To summarize, the present invention is a significant improvement over prior art MALSR systems and methods. Prior art systems are susceptible to failures due to massive surges and swings in transformer excitation. Previous attempts to mitigate these massive surges often involve adding expensive and sophisticated electronics to filter or soften the excitation changes. In contrast, the present invention provides a system and method of operating the system that progressively increases the intensity of runway approach lighting in response to requests for higher intensity settings, thereby avoiding massive surges and swings in transformer excitation and consequential problems. The present invention includes a back-to-back diode power sensor and a plurality of independently controlled inverse-parallel solid-state switches that, together, enable zero power level transition between at least three lighting intensity states. The solid-state switches are switched within about 7 degrees of zero power crossing, inducing less than 1% THD. A control module synchronizes the deactivation of one switch before activation of another switch while avoiding power dropout through the switches yet also avoiding damaging overlap or simultaneous operation of the switches. The control module includes digital processing that provides accurate power phase delays and dual high frequency pulsing for assured gating of the switches regardless of distorted power feeds and inadvertent SCR commutations. The system operates approach flashers and approach lights in a parallel redundant mode, wherein either control of the flashers or approach lights may be disconnected for diagnosis and service while leaving the other control operative. The system also includes an emergency bypass switch. In the event of any failure that may inhibit operation of the approach lighting, the bypass switch can be activated to default the approach lights to one of the intensity levels until diagnosis and service can be conducted. While in the emergency mode, the flashers operate normally if the flasher control board is operative. All of the TVSS networks are provided independent with respect to the control boards, so that changing the TVSS networks does not require changing either of the control boards. The present invention thus eliminates conventional, frequent nuisance breaker tripping in a MALSR, and eliminates excessive transformer excitation and controls failures. The present invention also enables optimized use of solid-state components and significantly extends lamp life of approach lighting and decreases flasher control card vulnerability to surges.

FIGS. 6A through 9 illustrate another exemplary embodiment of the present invention. This embodiment is similar in many respects to the embodiment of FIGS. 1 through 4 and like numerals between the embodiments may designate like or corresponding elements throughout the several views of the drawing figures. Additionally, some of the common subject matter may not be repeated herein below. While the previous embodiment described above is particularly well adapted for solid state switching of steady burners, it is also desirable to deploy the advantageous aspects of the present invention in the context of 1) steady burners that are switched using mechanical contactors, and 2) MALSR flasher control functionality. These steady burner and flasher functionalities are discussed herein below with respect to an alternative flasher control module or board (FCB) 134, shown in FIGS. 6A and 6B, that may be used in place of the flasher control board 34 of the control module 32 of FIGS. 1–1H. Although termed a "flasher" control board, the FCB 134 also includes structure and functionality for controlling operation of steady burner lamps that are switched with electromechanical contactors.

The FCB 134 provides many advantages. The FCB 134 is "universal" in that it can be used as a common controller for all variations of MALSR's and similar systems. A common control card solution eliminates the need to purchase high price obsolete replacement parts and reduces repair downtime of a MALSR. The FCB 134 is also universal in the sense that it is adapted for use with new MALSR installations, such as those having solid state switching functionality as described above in conjunction with the approach light control module 32 of FIG. 1, or instead for use with existing MALSR installations having electromechanical contactor switching functionality as will be described further herein below. The steady burners and flashers of the respective runway lighting arrays are operated and controlled in a parallel redundant mode, as evident from the schematic of FIGS. 1–1H and the associated discussion above. In other words, if the control for the steady burners fails, the control for the flashers remains fully functional, and vice versa.

The basic purpose of the FCB 134 is to receive intensity change command signals that request a change in magnitude of light intensity of the steady burner lamps and the flashers, process the request, execute power functions that control the lamp intensity of the steady burner array and the flasher intensity of the flasher array, and control the flasher trigger sequence of the flasher array including dual trigger synchronized outputs for the flashing runway end indicator lights (REIL's). As used herein, the REIL's and the flashers are similar in that they are both flashing lights, strobes, or strobe lights.

Figure 6:
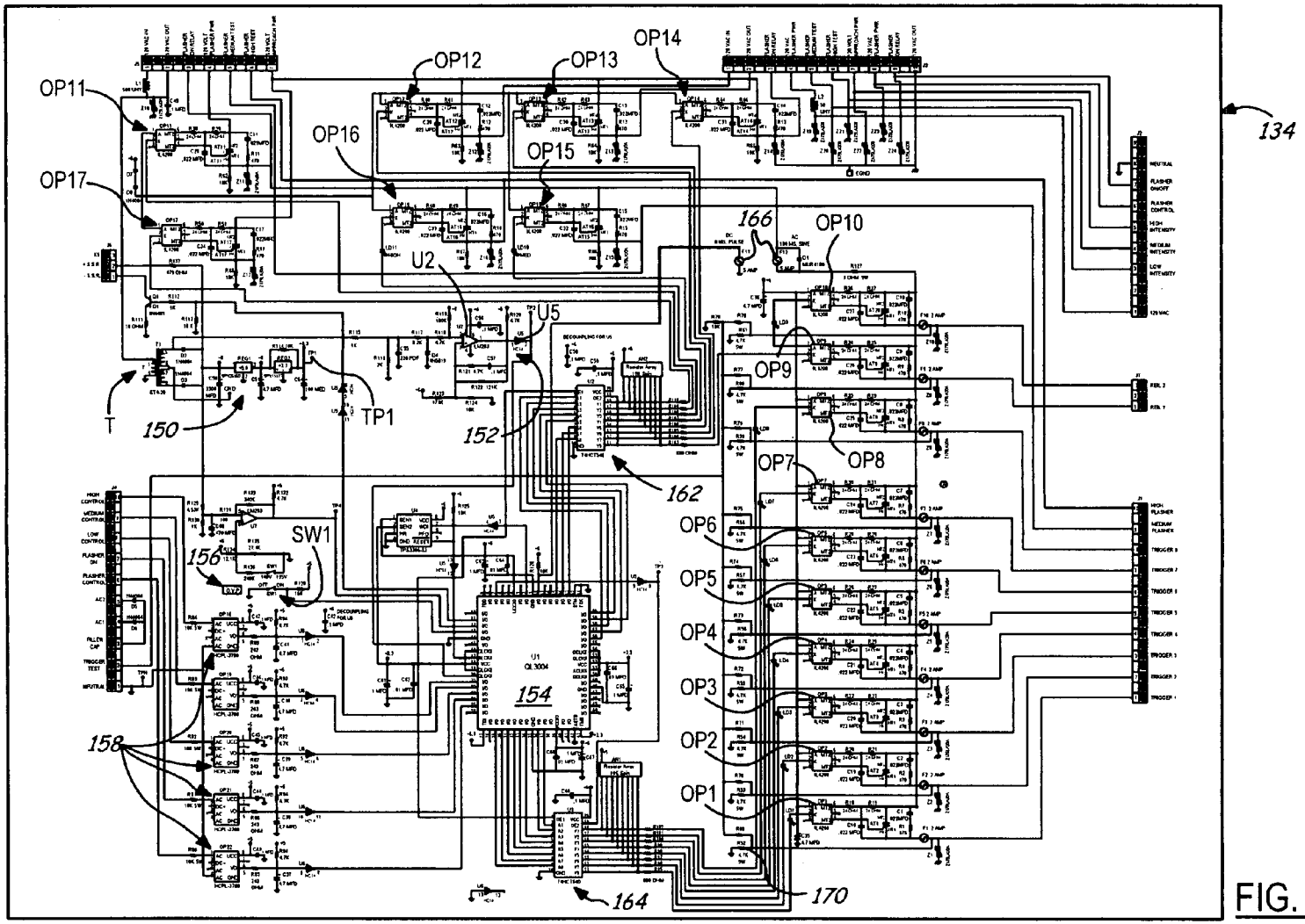
FIG. 6A is one half of a schematic diagram of a runway lighting control board in accordance with another exemplary embodiment of the present invention.
FIG. 6B is the other half of the schematic diagram of FIG. 6A.
Figure 6A:
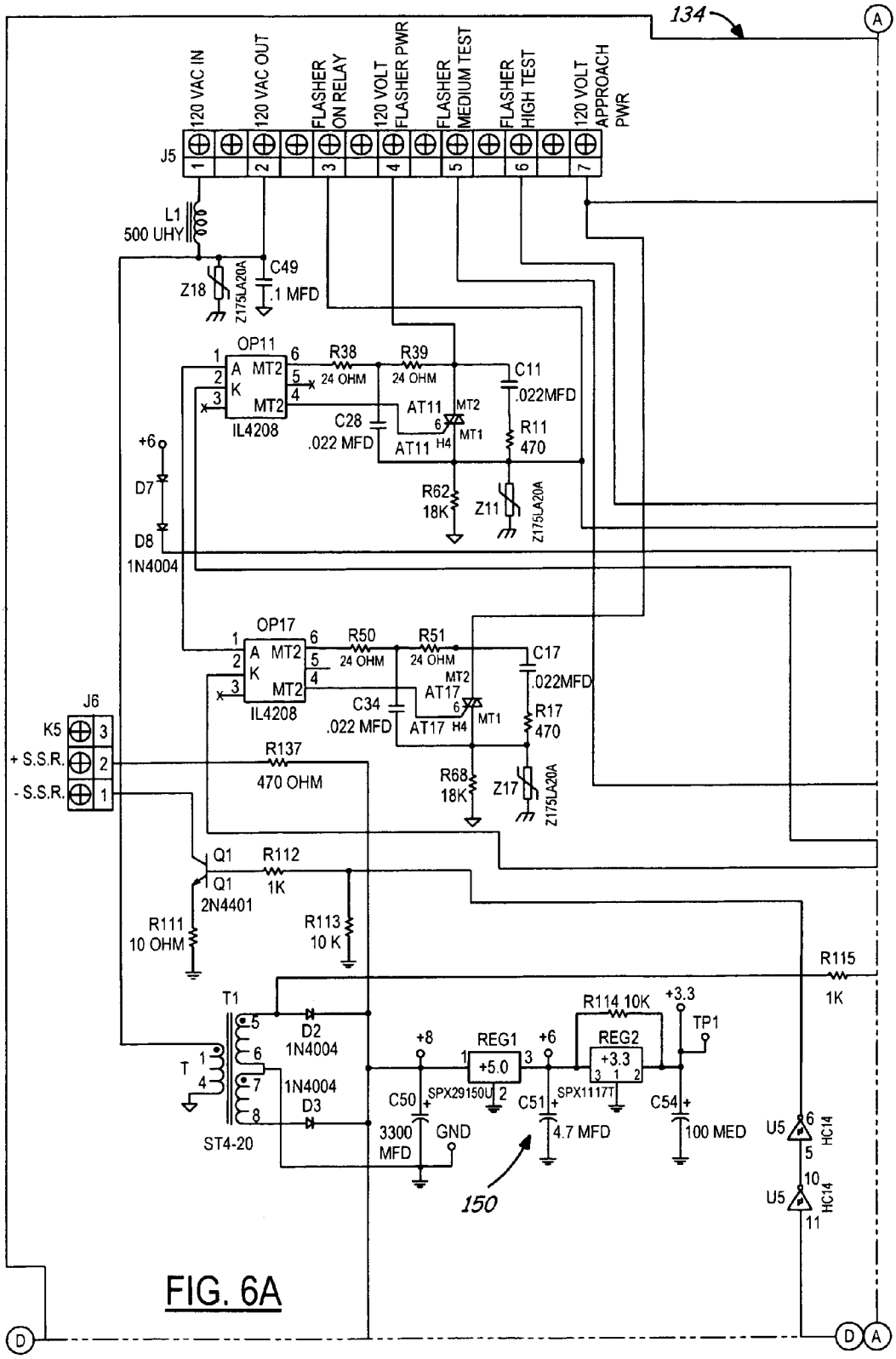
Figure 6B:
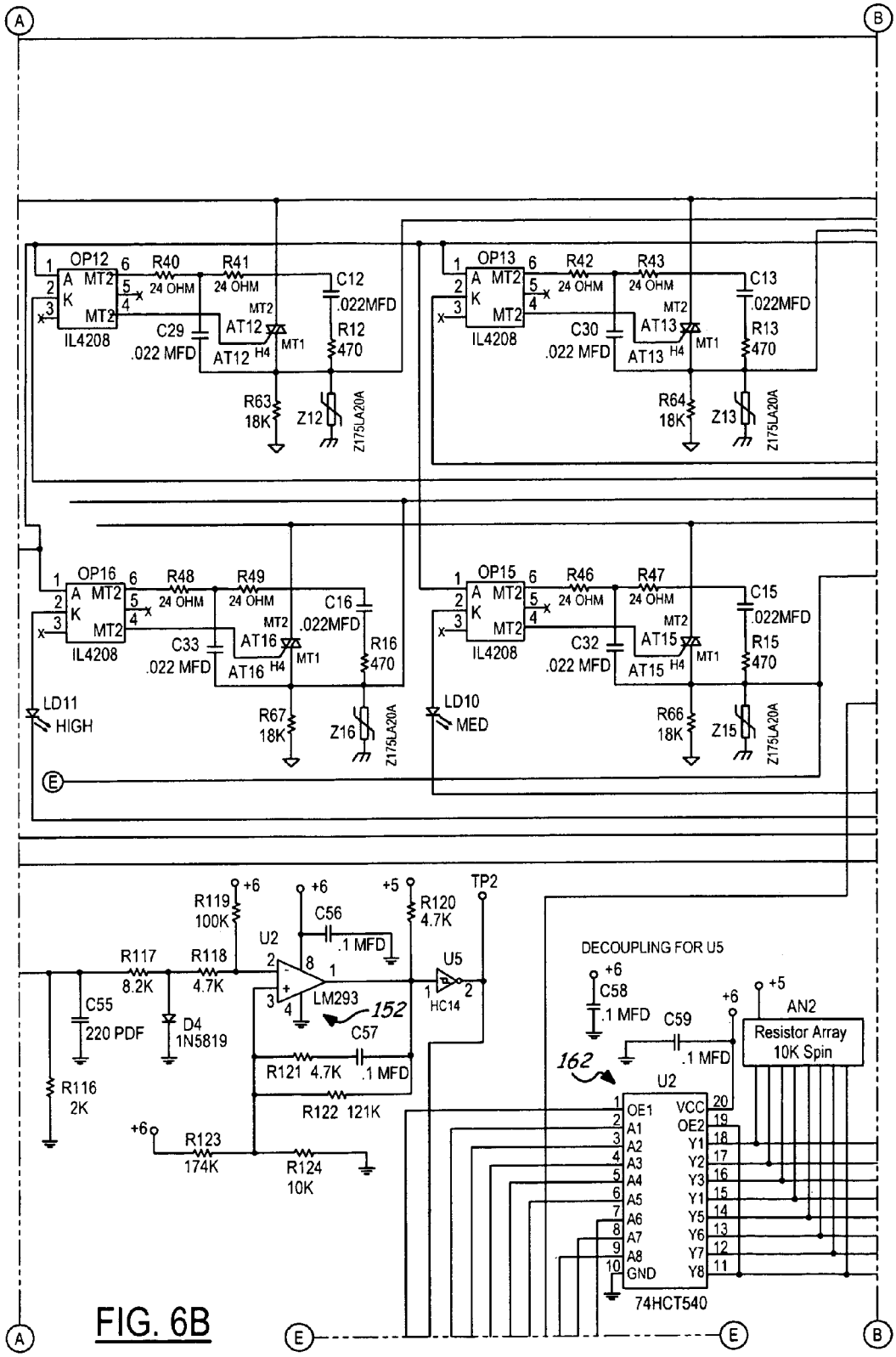
Figure 6C:
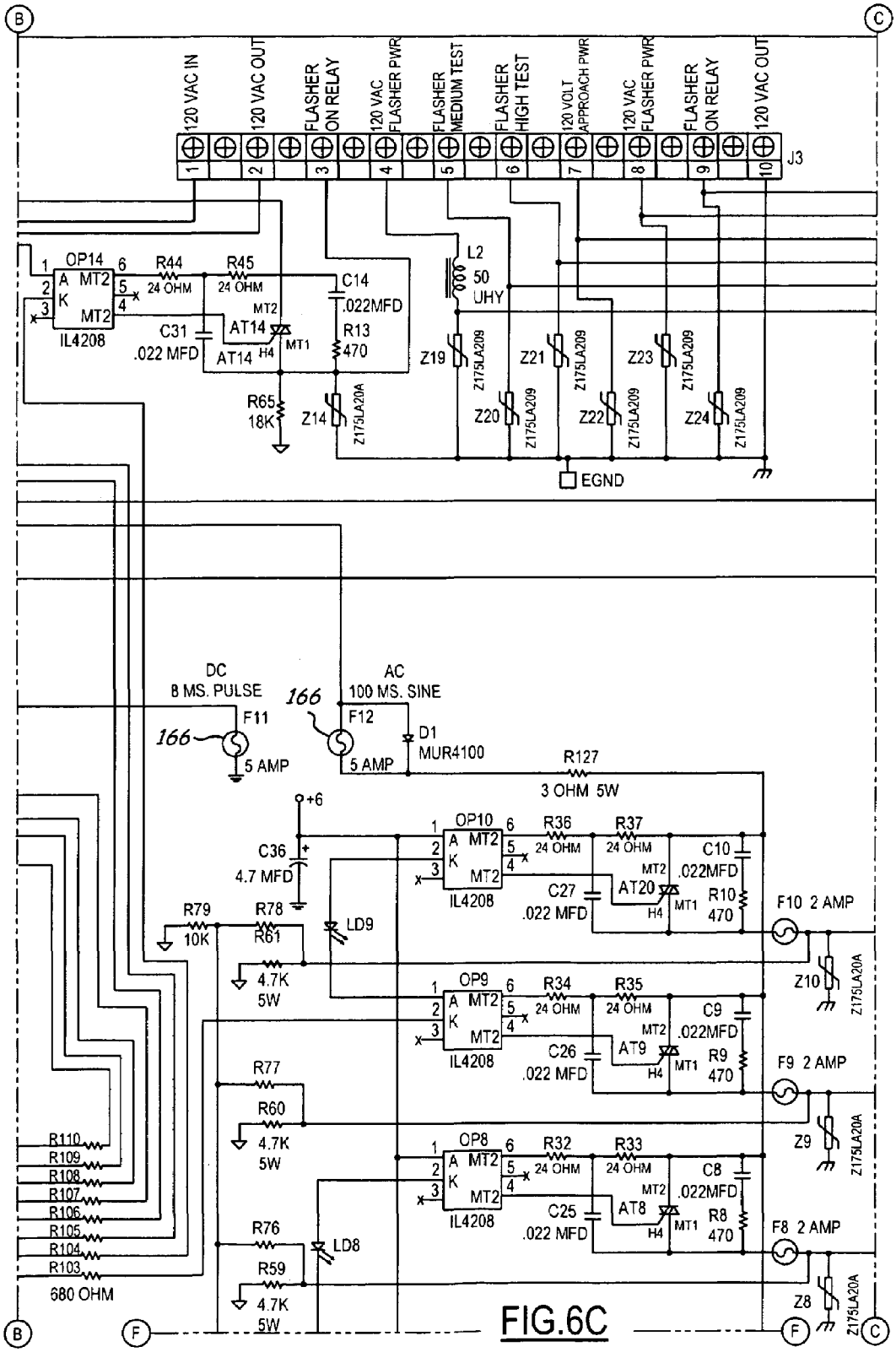
Figure 6D:
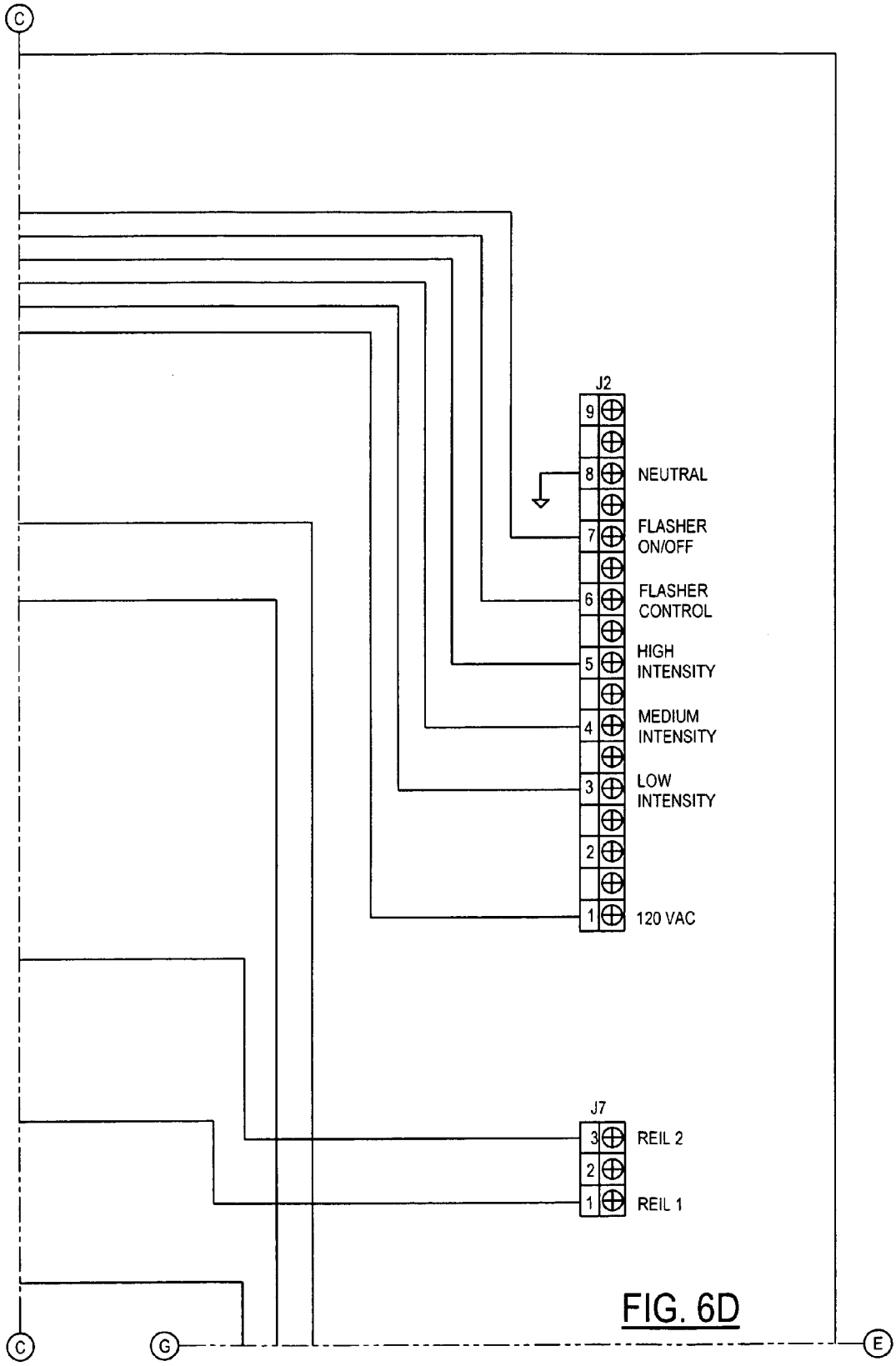
Figure 6E:
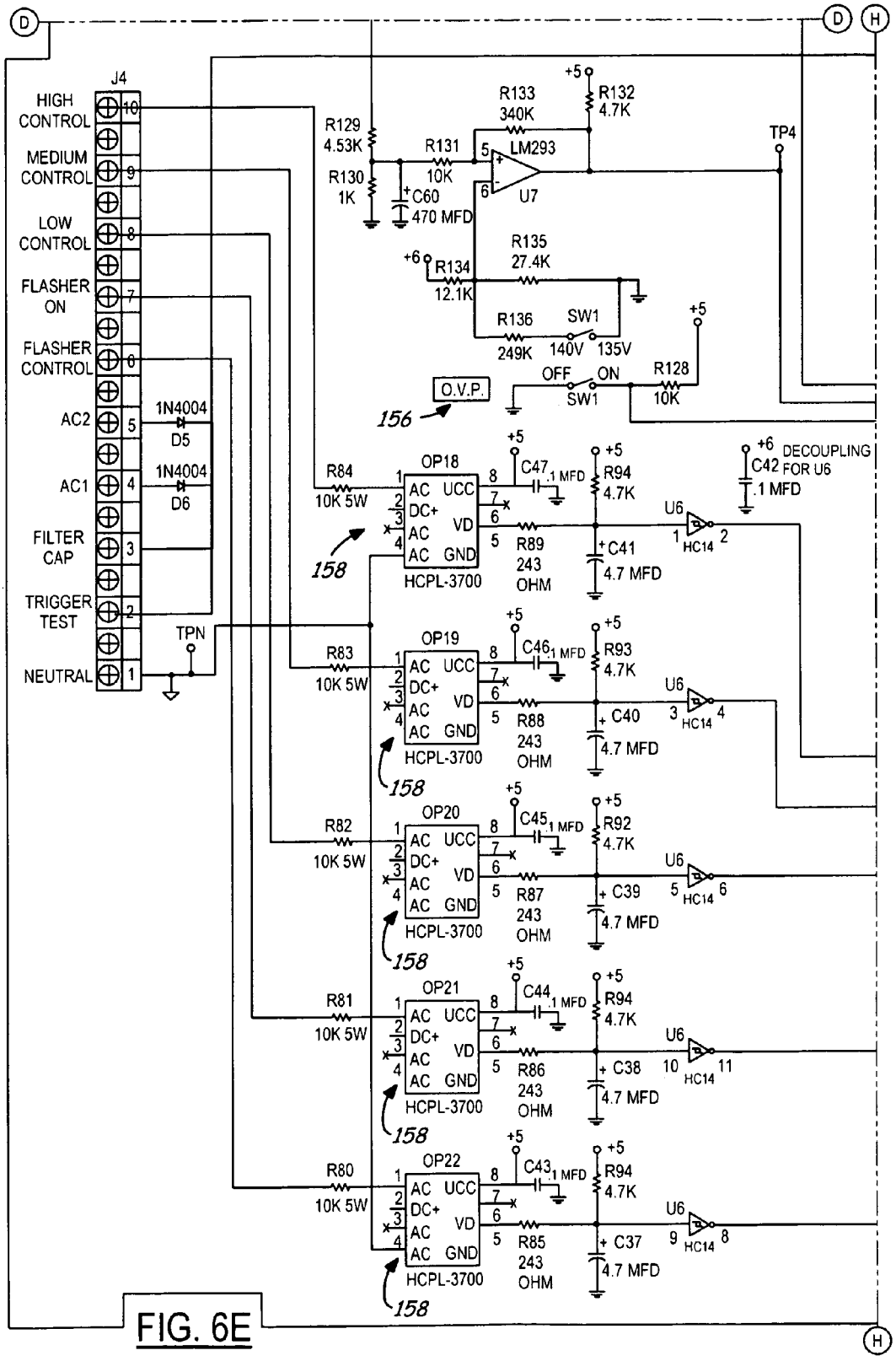
Figure 6F:
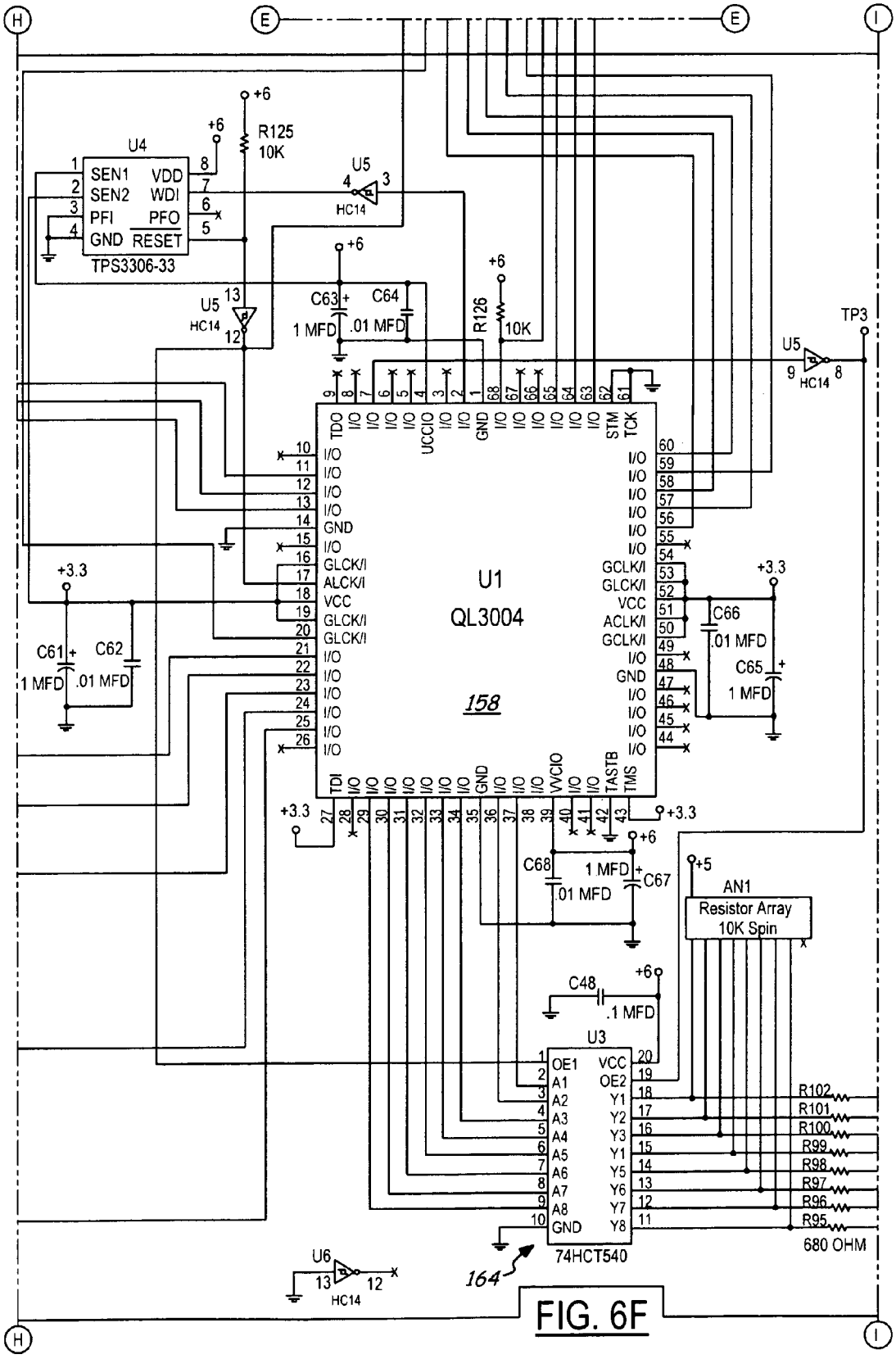
Figure 6G:
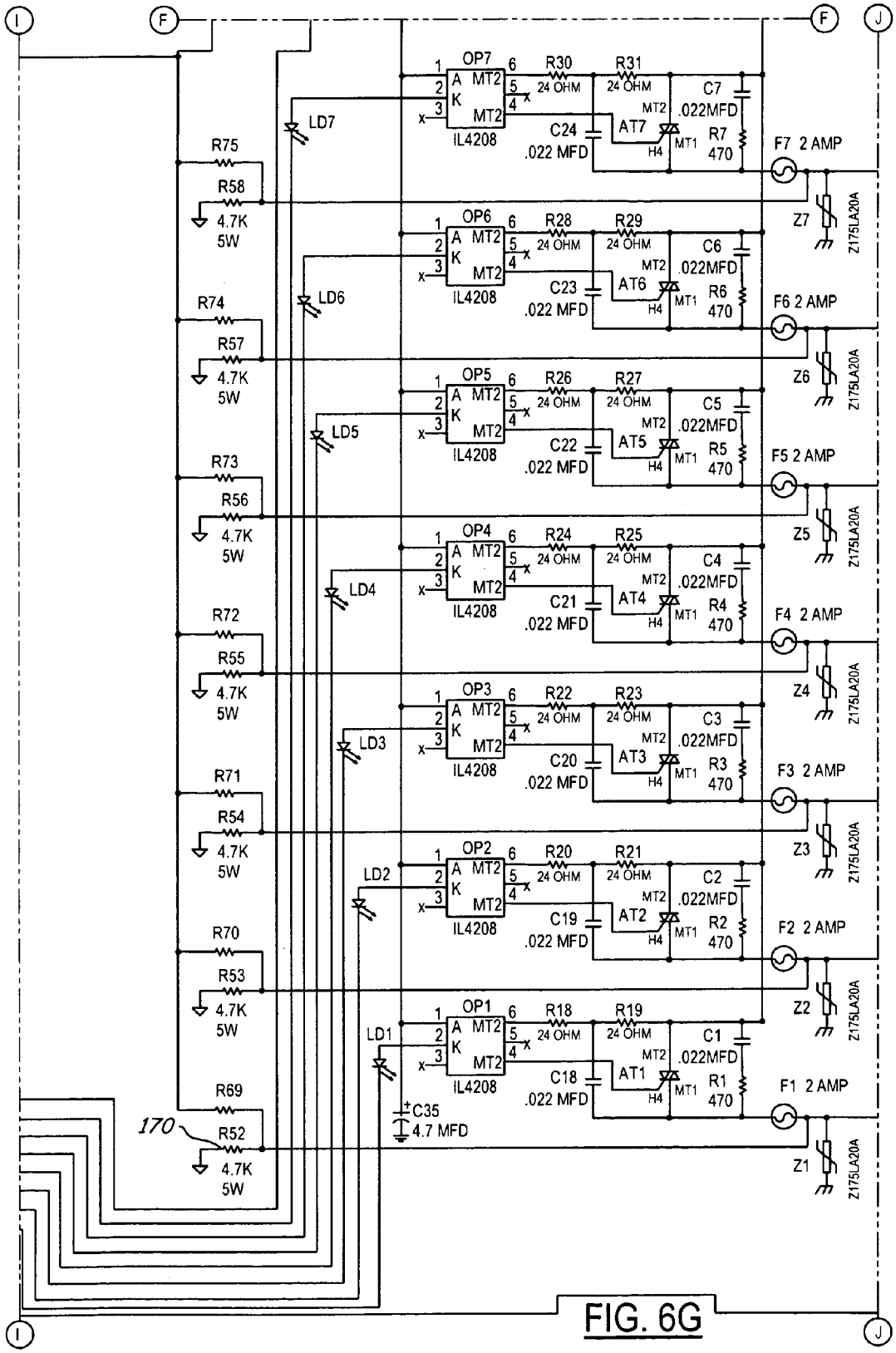
Figure 6H:
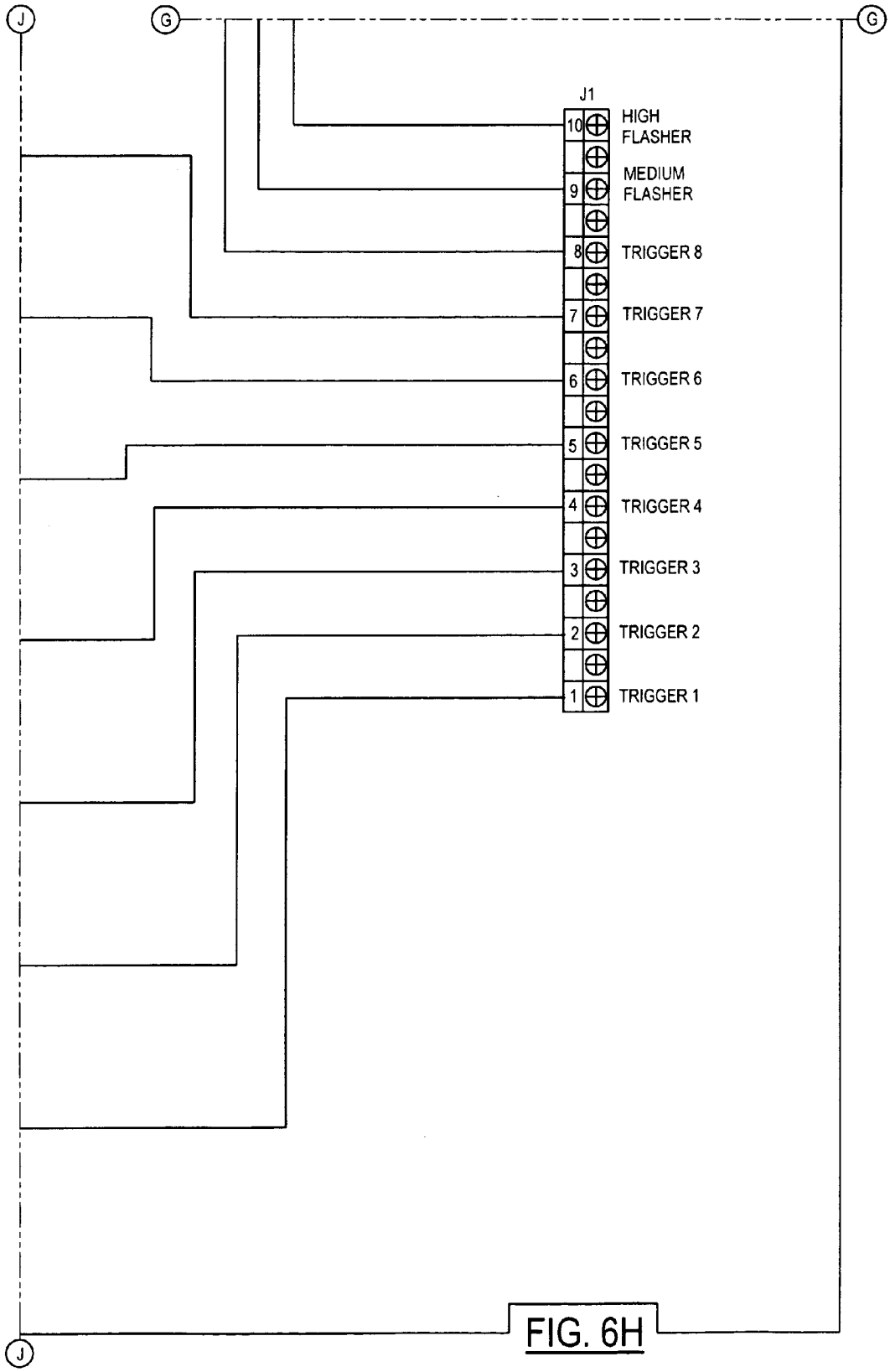

In general, and as shown in FIGS. 6A and 6B, the FCB 134 power supply, filter, and regulation circuitry operate from 120 vac at 60 Hz and preferably incorporate galvanic isolation circuitry. Unfiltered 120 vac power is routed into the FCB 134 through terminal 1 of strip J5 and is thereafter filtered and branched in two paths. In a first path, the power is brought out of the FCB 134 through terminal 2 of strip J5 for providing filtered power for input commands. In a second path, the power is transformed by a power supply or a transformer T and is regulated by regulator circuitry 150 to provide 3.3 vdc power at TP1, and the power is thereafter developed by clock circuitry 152, including a first portion of a comparator U2 (LM293) and a buffering Schmitt trigger U5 to present a clean square wave at 60 Hz for use by a processor such as an FPGA 154. The FPGA 154 is preferably a QuickLogic® QL3004 FPGA. It is contemplated, however, that any type of suitable processor could be used instead of an FPGA.

Another portion of the comparator U2, as part of over-voltage-protection circuitry 156, monitors the magnitude of the applied AC line voltage via a common line in the steady-burner transformer primary via terminal 2 of strip J6 as will be discussed in further detail below. Typically, utility power provides 240 or 120 volts from a utility power grid to points of use connected to the grid. Depending where any given point of use is in relation to an electrical sub-station or transformer on the grid, the voltage will vary, typically over a range of +/−10% of the nominal rated voltage. Accordingly, the over-voltage-protection circuitry 156 prevents application of voltages over the voltage rating of the lamps and is particularly effective for MALSR systems that historically experience excessive line voltages and attendant premature lamp failure. In the FCB 134, if the applied voltage exceeds some predetermined value, such as 10% or 15% of a nominal 120 vac line supply, then the comparator output will go "high" (such as +5 vdc as shown). Thereafter, if a selector switch SW1 is in the "on" position, the FPGA 154 "AND's" the received signals and inhibits the "high intensity" mode from going active. Thus, if the selector switch SW1 is set "on" and at 10%, then when the applied voltage reaches 132 volts only "low" and "medium" intensity levels are available. By setting the selector switch SW1 in its "off" mode, all intensity modes will be available, regardless of incoming line voltage levels. In other words, where it is imperative that lamps must be at their highest intensity level regardless of potential hazards, then switch SW1 may be selected to the off position to disable the over-voltage-protection circuitry 156.

As shown in FIG. 6B, unfiltered 120 vac power is routed into the FCB 134 through terminal 4 of strip J3, whereafter it is filtered and brought out of the FCB 134 through terminal 1 of strip J2. This filtered voltage out of J2(1) is used to establish the power for input commands. The input commands, including low, medium, high, flasher control, and flasher on, are returned to terminals 3–7 of strip J2, wherein terminals 2 and 9 thereof are unused, and terminal 8 is a neutral/ground. The input terminals of strip J2 may be connected to a local selector switch, or the like, as described previously with regard to the embodiment of FIGS. 1 through 4. The input commands are filtered for transients and routed out of terminals 5–9 of strip J3, wherein terminal 10 is earth grounded. The present invention contemplates that, in the absence of a specific request for medium or high intensity settings, the flasher and associated REIL's operate in the low intensity state by default, such as when a flasher on request is received. In other words, the default "on" state of the flashers is equivalent to a "low" intensity state of the flashers.

Referring to FIG. 6A, terminals 6–10 of strip J4 are preferably connected to a local selector switch, or the like, (not shown) for receiving intensity change request input signals and flasher input signals. For example, terminals 6–10 may be connected as shown with reference to FIGS. 1–1H, described above with respect to the previous embodiment. Terminal 6 is a flasher control input terminal, terminal 7 is a flasher on control input terminal, and terminals 8–10 are low, medium, and high intensity level control input terminals respectively. Strip J4 also includes terminal 1 to 120 vac neutral/ground, terminals 2–5 for use with an optional remote monitoring system (RMS), which is known to those of ordinary skill in the art. Specifically, terminal 2 is an RMS trigger test port, terminal 3 is a filter cap terminal for use with transformer tap terminals 4 and 5 that may be associated with a separately derived 20 vdc auxiliary power for RMS functions.

The input signals are fed through respective limiting resistors to respective opto-couplers 158 for optically isolating the input signals from the card ground reference. Any suitable opto-coupler may be used such as HCPL-3700 available from the Hewlett-Packard Company, or the like. The present invention also typically uses these opto-couplers 158, or similar opto-couplers, to provide isolation and withstand voltage for the outputs, as well as these inputs, on the order of 2,500 volts. The opto-couplers convert the AC input signals to DC pulses of 2.85 msec duration spaced 8.3 msec apart and these pulses are filtered, and buffered by Schmitt triggers, and thereafter communicated to the FPGA 154.

In general, the FPGA 154 de-bounces the input signals, performs intensity change request recognition on the input signals, decodes intensity change request signals to binary format for the contactors to eliminate input magnitude request command overlaps that are faster than the mechanical operation of the output contactors. More specifically, the FPGA 154 de-bounces the input signals for about 250 msec to insure that transients or repetitive overlap switching is ignored such that only one solid signal is processed at a time. Upon receiving an acceptable, de-bounced signal, the FPGA 154 then decodes the intensity change request input signals. For example, the FPGA 154 may decode a medium intensity level input request in a 011 format to a 010 binary format.

The FPGA 154 generates binary output commands that are sent to low, medium, and high intensity opto-coupled switches OP12–OP14 by way of a decade counter 162, such as a 74HCT540 octal buffer/line driver, 3-state, inverting decade counter available from Philips Semiconductors. Accordingly, the steady burner intensity level output commands are all optically isolated using these low power, high isolation opto-coupled switches OP12–OP14 before connecting to strip J3, terminals 1–3, which connect to steady burner contactor coil drivers (K1–K3). An exemplary opto-coupler is an IL4208 available from Vishay Semiconductor. As shown, the triac output of each opto-coupler preferably drives an alternistor that is rated at 6 amps/1000 volts and is capable of direct driving the contactor coils (K1–K3). The alternistors are basically modified triacs that are designed to better handle inductive loads as well as resistive loads and are controlled to turn on and off at zero volts. As also shown, external snubbers are added to ensure a safe dv/dt value and 18K Ohm resistors shunt the coil drives to offer a resistive bleed path for any inductive flyback that may be encountered at the contactor coils. As used herein, the terminology "opto-coupled switch" may encompass not only the opto-coupler itself, but also the triac or alternistor associated therewith, and any other desired circuitry such as the snubbers.

The FCB 134 enables improved control of steady burner arrays using electromechanical contactors, as opposed to the solid state switches Q3–Q5 of FIGS. 1 through 1H. Generally, the FCB 134 incorporates the same forced staircase switching described in the previous embodiment, uses dwell timing to avoid switching overlaps, and adapts existing contactor style MALSR's to solid state zero power switching.

Figure 7A:
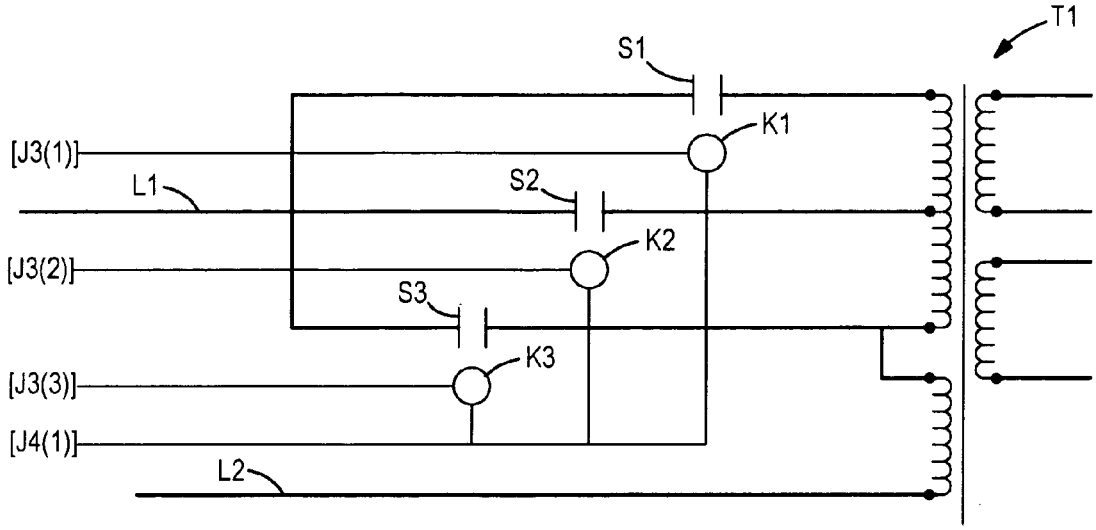
FIG. 7A is a schematic diagram of a portion of a steady burner transformer of a MALSR control system according to an electromechanical contactor embodiment of the present invention.

Referring generally to FIGS. 6A through 7A, delayed switching or dwell timing is used to avoid contactor overlap conditions. The FCB 134 is preferably coupled to electromechanical contactor coils K1–K3 in a portion of a steady burner transformer control circuit according to an embodiment that is similar, but alternative, to that of FIG. 1. As shown in FIG. 7A, the contactor coils K1–K3 are shown symbolically connected to the FCB 134 of FIG. 6A using bracketed indicia, such as [J3(1)] to indicate the terminal strip and terminal connection. It is contemplated that this embodiment may include any or all of the other structure of FIG. 1 such as the bypass switches, load monitors, and the like. Overlap of two or more contactors S1, S2, S3 at once allows transformer T1 tap-to-tap circulating currents up to about 6,000 Amps. Therefore, with the present invention, a contactor is permitted to go "off" before another contactor is turned "on" to prevent contactor overlap, which is responsible for breaker tripping and premature contactor failure. The FPGA 154 adds dwell time to the output commands that drive the opto-coupled switches OP12–OP14 that, in turn, switch the contactor coils K1–K3, in order to allow settling of one of the contactors S1–S3 prior to commanding any other of the contactors S1–S3.

Figure 7B:
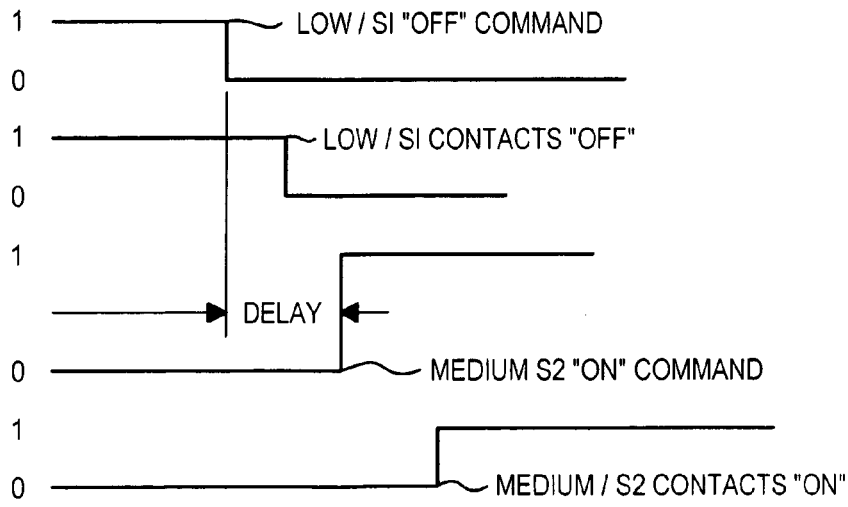
FIG. 7B is a sample timing diagram of a lighting intensity change from low to medium intensity commanded by the control board of FIGS. 6A and 6B.

Referring now to FIG. 7B, there is shown a sample low to medium intensity change plot of commands with a dwell or delay therebetween. Initially, upon receiving an intensity change request from one level to another, the FPGA 154 commands a currently closed contactor to "open" or "turn off" following the de-bounce and signal acceptance by the FPGA 154. Subsequently, a predetermined dwell period such as 50 msec is added prior to the FPGA 154 initiating a command to activate another contactor.

Although not shown in the drawings, each contactor S1, S2, S3 and/or its associated contactor coil K1, K2, K3, is provided with an auxiliary contactor. The auxiliary contactor mimics the operation of the power contactor and provides an associated on or off signal back to the FCB 134 or other controller. Accordingly, the FCB 134 can, among other things, monitor the performance of the contactors to ensure that a given contactor has actually responded to one command signal before the FCB 134 issues another command signal to another contactor.

In any case, the dwell period ensures that there is no overlap operation of a commanded "off" contactor and a commanded "on" contactor due to the time it takes for the mechanical contactors to open and close. This prevents a multiple contactor overlap condition of about 4–8 msec that can result in 1,200–1,800 Amp overloads that exceed the rating of the contactor and thereby cause contactor pitting, welding, and corresponding premature failure. Finally, after the dwell period, the FPGA 154 outputs the command for the appropriate contactor associated with the intensity request.

Even with this dwelled switching, however, current inrush excitation typically associated with the energization of transformers can be as high as 600 Amps. This is because a typical electromechanical contactor opens and closes without regard to the instantaneous amplitude of the power sine wave applied therethrough. In other words, the contactor has no control over when or where in the sine wave of applied power it is switched on or off. If the contactor is activated at the peak of the sine wave (90 degrees), then the inrush current can be 8 to 15 times the full load running current. Therefore, it is desirable to apply the zero power switching teachings from the previously described embodiment to control on and off switching of the contactors. As used herein, zero power switching means switching at substantially zero power and may be considered equivalent to zero voltage and/or zero current switching, depending on the application involved. This technique has been found to reduce current inrush excitation ten-fold to a typical maximum of about 60 Amps.

Referring to FIG. 6A, the FCB 134 generates zero power switching control command output signals via the FPGA 154, and includes a terminal strip J6 for connecting to zero power switching components in a common line of the transformer primary as will be discussed in greater detail below. Through terminal 2 of strip J6 of the FCB 134, the FPGA 154 receives a line power signal from the steady-burner transformer primary common line that is run through the over-voltage-protection circuitry 156 as previously described above. The FPGA 154 outputs a relay command through terminal 1 of strip J6 for use in switching a solid state relay as will be described herein below. No optical isolation is necessary for this route as the solid state relay is inherently isolated. Also, the FPGA 154 outputs a contactor coil command through an opto-coupled switch OP17. The opto-coupled switch OP17 controls flow of steady burner power from terminal 7 of strip J5 to a contactor coil in the steady-burner transformer primary common line, as will be discussed in further detail herein below.

Figure 8:
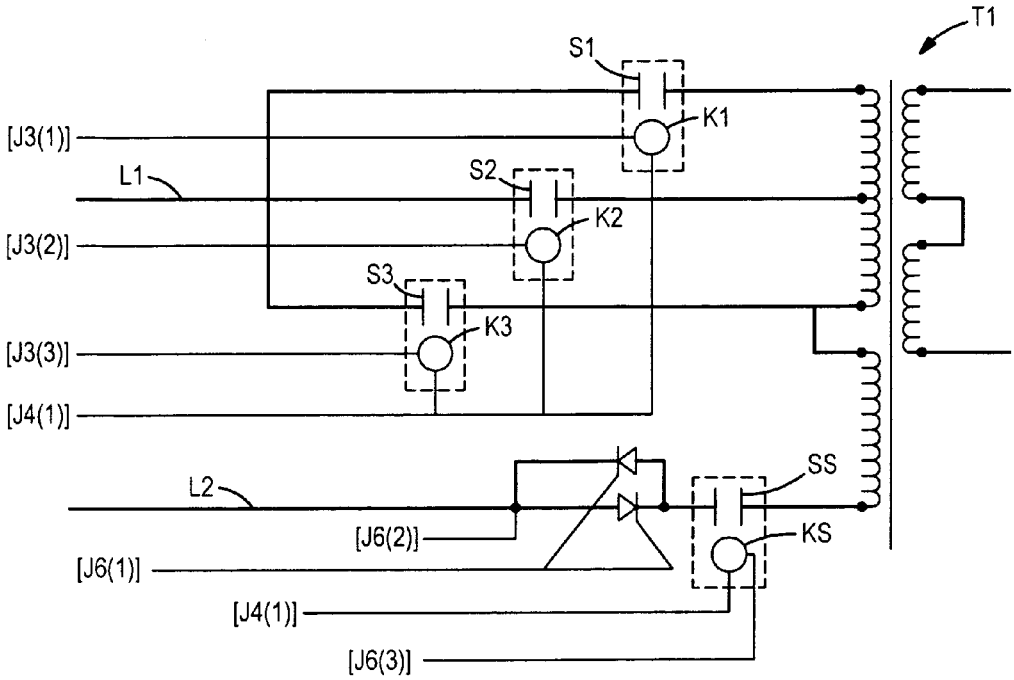
FIG. 8 is a schematic diagram of a portion of a steady burner transformer of a MALSR control system according to a further electromechanical contactor embodiment of the present invention, incorporating solid state zero power switching hardware in series arrangement.

The FCB 134 provides additional contactor arcing prevention using solid state switches, as shown in FIG. 8. In other words, the FCB 134 is adapted for use with external electronic power switching for lamp level intensity changes. Basically, the FCB 134 operates to ensure that lighting intensity change or switching occurs only at substantially zero power to eliminate arcing and voltage spikes to preserve the integrity of the contactors. It has been found that associated peripheral equipment, such as an RMS lasts longer with this feature.

As shown in FIG. 8, the card is preferably coupled to electromechanical contactors S1–S3 in a portion of a steady burner transformer control circuit according to embodiment alternative to that of FIG. 1. Again, it is contemplated that these embodiments may include any or all of the other structure of FIG. 1 such as the bypass switches, load monitors, and the like. Terminals 1–3 of strip J3 of the FCB 134 connect to the respective relays or contactor coils K1–K3 of the respective contactors S1–S3. Terminal 1 of strip J6 connects to gates of solid state relays SSR, terminal 2 of strip J6 connects to line L2 of the transformer primary, and terminal 3 of strip J6 connects to a coil K5 of a contactor S5 in line L2 of the transformer primary. With the contactor S5 in an open or off state, the FPGA 154 sends the output command signal to the desired low, medium, or high opto-coupled switches OP12–OP14, as previously described above. Thereafter, the FPGA 154 executes solid state relay SSR and contactor relay K5 commands. In FIG. 8, the relay SSR is in series with the contactor S5 and is switched on after the contactor S5 has transitioned "on", and is switched "off" before the contactor S5 transitions "off". Therefore, the FCB 134 ensures that intensity level changes via the contactors S1–S3 occur substantially at zero power to eliminate arcing and voltage spikes to preserve the integrity of the contactors S1–S3. To sense when the contactor S5 has transitioned on or off, an auxiliary contactor may be used as described previously above.

In an arrangement alternative to that of FIG. 8 and not shown, it is contemplated that the relay SSR could be placed in parallel with the contactor S5 wherein the FPGA 154 switches the relay SSR "on" before the contactor S5 transitions "on", and switches the relay SSR "off" after the contactor S5 transitions "off". This arrangement, however, would require placement of similar relays in parallel with each of the contactors S1–S3 and would further require additional controls associated therewith.

The apparatus of FIG. 8 and related signal sequencing ensures that the intensity level contactors S1–S3 are switched at values under about 100 Amps, instead of uncontrolled start-up excitation currents of up to about 1,200 Amps. Electromechanical contactors in existing MALSR's do not include the zero power switching functionality and are typically replaced as frequently as once or more per year. The optional zero power switching functionality of the present invention, however, ensures that the contactors S1–S3 do not switch on or off under significant power applied therethrough, thereby preserving the contacts and narrowing the failure mode of the contactors S1–S3 to that of mechanical wear only. Thus, the contactors S1–S3 should last for their mechanically rated level of 1,000,000+operations, or about 24 years at 100 operations per day. In any event, a MALSR without the optional zero power switching commands and hardware will function adequately, wherein the dwell timing and/or staircase sequencing of the intensity contactors S1–S3 ensures no overlap of contactor operation, to preclude primary tap short circuits and circuit breaker tripping.

Referring to FIGS. 6A and 6B, the FCB 134 also generates the correct timing for the flasher and REIL triggers, and provides the intensity change command signals for the flashers after providing the intensity change command signals for the steady burners. 120 vac flasher power is routed into the FCB 134 through terminal 4 of strip J5, wherein the power is isolated and controlled by an opto-coupled switch OP11 (and associated alternistor, as is common on the FCB 134). Thereafter, the power is filtered and then branched in two paths. In the first path, power flows out of the FCB 134 through terminal 3 of strip J5 for connection to a flasher on relay coil as will be described in further detail herein below. In the second path, power flows downstream to supply power to flasher trigger opto-coupled switches OP1–OP8 and REIL trigger opto-coupled switches OP9–OP10, to a flasher medium intensity opto-coupled switch OP15, and to a flasher high intensity opto-coupled switch OP16. Again, as used herein, the terminology "opto-coupled switch" may encompass not only the opto-coupler itself, but also the triac or alternistor associated therewith.

The FPGA 154 commands steady burner intensity changes before commanding flasher intensity changes. In other words, the operation of the flasher "on" opto-coupled switch OP11 depends on the operation of the steady burner "on" opto-coupled switch OP 17, wherein the steady burner "on" switch OP17 is wired "upstream" of the flasher "on" switch OP11. As shown in the wiring of FIG. 6A, in order to execute a flasher intensity change, the flasher "on" opto-coupled switch OP11 must receive the steady burner on signal indirectly from the FPGA 154 through the steady burner "on" opto-coupled switch OP17 and an independent flasher on command signal directly from the FPGA 154. If both command signals are being received by the switch OP11, then the flashers are automatically defaulted to the low intensity state as will be evident from the discussion herein below with reference to FIG. 9. Similarly, the operation of the flasher train and REIL trigger switches OP1–OP10, and the flasher medium and high intensity switches OP15, OP16 depends on the operation of the flasher "on" switch OP11, wherein the flasher "on" switch OP11 is wired "upstream" of the flasher intensity switches OP15, OP16 and the flasher trigger switches OP1–OP10.

The FCB 134 enables two selectable types of flasher and REIL trigger timing. The FCB 134 is adaptable to control either electronic digital pulse flashers that require a relatively short 8 msec DC pulse signal for triggering, or electromechanical relay or cam-driven flashers that require a relatively longer 100 msec AC sine signal. In either case, the FPGA 154 drives a plurality of flasher trigger opto-coupled switches OP1–OP8 by way of a decade counter 164, such as a 74HCT540 octal buffer/line driver, 3-state, inverting decade counter available from Philips Semiconductors. The FPGA 154 drives a plurality of REIL trigger opto-coupled switches OP9–OP10 by way of the decade counter 162. As with the contactor output opto-coupled switches, each opto-coupler may be an IL4208 available from Vishay Semiconductor. Again, the triac output of the opto-couplers preferably drive alternistors that are switched on and off at zero volts.

The trigger type is selected by relocating a plug-in fuse 166 on the FCB 134 between a DC socket and AC socket. When the fuse 166 is in the DC socket, a pin on the FPGA 154 is grounded and the 100 msec AC triggering sequence is invoked in the FPGA 154. But when the fuse 166 is removed from the DC socket to be relocated to the AC socket, then the same pin on the FPGA 154 goes to a positive voltage or high state, thereby invoking the 8 msec DC triggering sequence in the FPGA 154. In other words, this relocation of the fuse 166 automatically instructs the control logic in the FPGA 154 to perform the correct routine and reroutes the trigger power source to the correct power type. Whichever of the DC and AC modes are chosen, the flasher and REIL trigger outputs operate according to the same mode.

The flasher trigger signals may be analog, sine-derived pulses for driving relay logic input flashers or REIL's. The sine-derived pulses are 100 msec in duration and comprised of six each 60 Hz sine waves from the 120 vac line power, by selecting the appropriate location of the fuse 166.

Preferably, however, the flasher trigger signals are digital pulses, which are produced using the 120 vac 60 Hz utility line. Ten flasher trigger signals for the flashers are produced via a 60 Hz utility line synchronized clock (16.6 msec) wherein each on trigger pulse is positive, 8.3 msec in duration, with an off delay of about 25 ms between the eight flasher pulses and a 63–64 msec delay (or about two flash intervals) between the last flasher trigger pulse in the flasher train and the dual REIL trigger pulses. A brief delay is interposed between the dual REIL pulses and the beginning of the next cycle starting with the first flasher pulse. The magnitude of the delay is preferably that which enables the entire flasher and REIL cycle to occur about twice per second. The flasher triggers and REIL trigger are visually represented by light-emitting-diodes LD1–LD8, and LD9 respectively, and the flasher intensity levels are visually represented by the light-emitting-diodes LD10–LD11.

The flasher trigger and REIL output command signals are well protected. First, the command signals are all optically isolated using the low power, high isolation opto-coupled switches OP1–OP8 and OP9–OP10 before respectively connecting to terminals 1–8 of strip J1 that connect to flasher triggers external of the FCB 134, and terminals 1–2 of strip J7 that connect to REIL triggers external of the FCB 134. Second, the FCB 134 incorporates independent fused trigger outputs, as shown downstream of the alternistors 160, that are fused at 33% of device driver parameters to protect the sensitive electronics of the FCB 134 in the event of short circuiting and power surges. Third, all triggers are shunted with 4.7K Ohm resistors 170 to provide a relatively low output impedance of the output circuitry while in the "off" state, for static bleed and to minimize the generation of high voltage buildup of transients.

Figure 9:
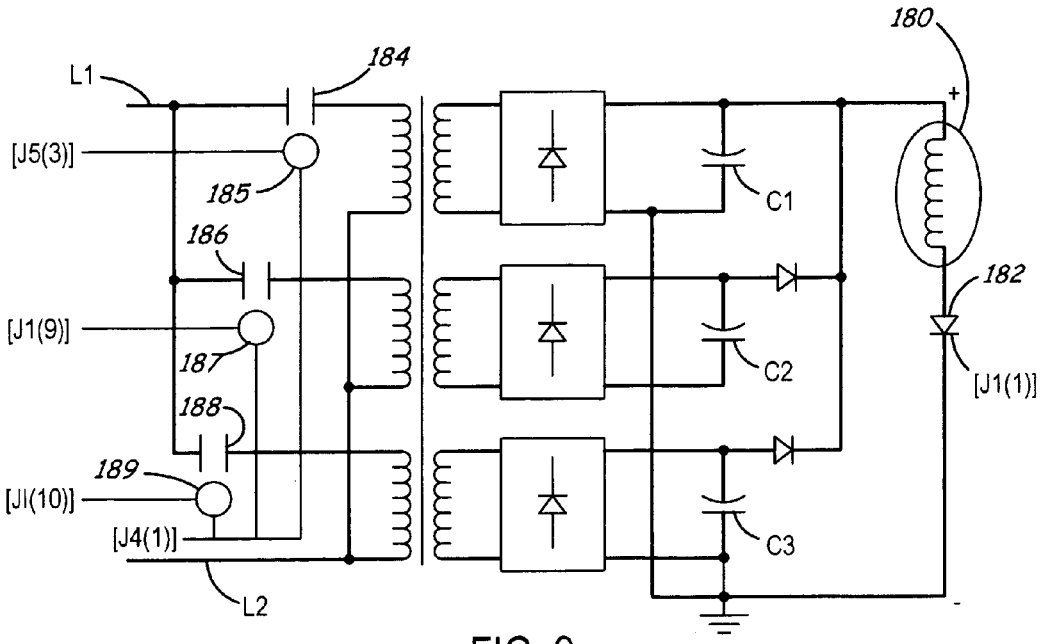
FIG. 9 is a schematic diagram of a portion of an exemplary flasher charge/discharge circuit.

Referring now to FIG. 9 in conjunction with FIGS. 6A and 6B, there is shown a typical flasher charge/discharge circuit that is exemplary of each of the individual flasher and REIL charge/discharge circuits. FIG. 9 illustrates, for example, a first flasher 180 of the flasher array that is coupled across any desired power supply (not shown) and is triggered by series connection to a solid state trigger switch 182, which is gated by trigger signals received through connection to terminal 1 of strip J1 of the FCB 134. Low, medium, and high intensity level capacitors C1, C2, C3 are placed across the flasher 180 and trigger switch 182. The flasher on (or low), medium, and high intensity contactors 184, 186, 188 are coupled across power lines L1 and L2 and are individually electromagnetically coupled to their respective capacitors C1, C2, C3 via transformer/rectifier combinations, which convert the 120 vac line power to about 2,000 vdc flasher power. The flasher "on", or low, contactor relay or coil 185 is activated by a flasher on signal received through connection to terminal 3 of strip J5 [J5(3)] of the FCB 134. The medium contactor coil 187 is activated by a medium intensity command signal received through connection to terminal 9 of strip J1 of the FCB 134, and the high contactor coil 189 is activated by a high intensity command signal received through connection to terminal 10 of strip J1 of the FCB 134. Each of the contactor coils 185, 187, 189 are tied to common terminal 1 of strip J4 of the FCB 134. The present invention contemplates that each of the contactors 184, 186, 188 and associated coils 185, 187, 189 can each be considered a "switch", and the present invention can be adapted for other switches such as solid state switches, and the like.

The intensity of the flashers is controlled by the duration of the "on time" of the flasher flashtube, wherein the duration of the flash is a function of the available energy Q, wherein $Q=e^2*C$, and e averages about 2,000 vdc. The flasher array is switched in progressively increasing values of capacitance. For example, 1 microfarad, 3 microfarad, and 26 microfarad capacitors are used for the low, medium, and high capacitors $C_1$–$C_3$ respectively. Accordingly, increasing the capacitance provides a longer discharge time, thereby making the flash of each flasher appear to be brighter.

But if intensity level switching is not controlled to avoid linking the capacitors C1–C3 together at different voltage levels, then the flashers 180 tend to fail prematurely. The flasher intensity level contactors 186, 188 will frequently open and close at high voltages across the contacts, thereby drastically reducing the life of the contactors 186, 188 by burning and pitting the contactor contact surfaces. Arcing of the flasher contactors 186, 188 is particularly troublesome when a flasher intensity change command immediately follows, or is simultaneous with, a flasher trigger signal. In other words, if an intensity change command occurs immediately following a strobe pulse, then the capacitor that supplied the strobe energy is fully discharged at the instant the other capacitors are fully charged. Accordingly, the relay will open or close with a 1,500–2,000 volt potential difference impressed across the contacts and the contacts will arc as they bounce to stabilize or attempt to open the circuit. Fortunately, a discharged capacitor resumes charging every 8 msec while the relay operation takes about 20 msec, thereby reducing the potential difference. Nonetheless, it has been discovered that relay arcing tends to occur about twenty to thirty percent of the time that flasher relays are powered on or commanded to change intensity.

Therefore, the present invention solves these flasher relay arcing problems. Still referring to FIGS. 6A and 6B and FIG. 9, the FPGA 154 incorporates a pre-programmed timing sequence that ensures that the medium intensity contactor 186 and high intensity contactor 188 switch at substantially zero volts, thereby enhancing the life of the flashers 180. During any intensity transition, the FPGA 14 momentarily dwells or inhibits the flasher triggers to allow voltage of the capacitors C1–C3 to equalize. In other words, the FPGA 154 provides a trigger inhibit and a transition waiting period to allow the capacitors C1–C3 of each of the flashers 180 in the array to recharge to substantially the same voltage. This allows the contactors 186–188 to open and close at substantially the same potential across all of the contacts thereof. In essence, the FPGA 154 requires a sequence of events to ensure that there is neutralizing time, such as about 1 second, between triggering, relay switching, and capacitor charge to switch the contactors 184–188 at zero volts. The flasher "on" switch OP11 is momentarily disabled when the steady burner "on" switch OP17 being momentarily disabled to effect the optional zero power switching of the steady burners as described previously. Therefore, the flasher and REIL trigger switches OP1–OP10, and the medium and high flasher intensity switches OP15, OP16, are likewise momentarily disabled. Just as, or before, the flasher "on" switch OP11 receives command signals from the FPGA 154 directly, and indirectly through the steady burner "on" switch OP17, the FPGA 154 executes a short delay or inhibit on the flasher and REIL trigger commands so that a flasher intensity change can take place without interference from flasher triggering.

While the forms of the invention herein disclosed constitute a presently preferred embodiment, many others are possible. Moreover, any given embodiment disclosed herein, and any features associated therewith, are interchangeable and incorporated by reference into any other given embodiment disclosed herein. Accordingly, the present invention contemplates that each feature of each embodiment disclosed herein is combinable with other features of the other embodiments disclosed herein. It is not intended herein to mention all the possible equivalent forms or ramifications of the invention. It is understood that terms used herein are merely descriptive, rather than limiting, and that various changes may be made without departing from the spirit and scope of the invention as defined by the following claims.

What is claimed is:

1. An aircraft landing guidance system for visually guiding an aircraft in its landing approach to a runway having an approach area equipped with a plurality of lights operable in accordance with a plurality of intensity states including at least a low state, a medium state, and a high state, said plurality of lights including a plurality of strobe lights being coupled across at least one power supply, said system comprising:

at least one input source for requesting said plurality of lights to operate in accordance with said plurality of intensity states, said at least one input source receives a plurality of lighting intensity requests including a low request, a medium request, and a high request that correspond respectively to said low, medium, and high states of said plurality of lights, said at least one input source being capable of receiving a request for change in lighting intensity from one of said states to another;

circuitry for charging and discharging said plurality of strobe lights, said circuitry including:

at least one strobe trigger switch connected to at least one strobe light of said plurality of strobe lights;

a plurality of capacitors coupled across said at least one strobe light including:

at least one high intensity capacitor coupled across said at least one strobe light;

at least one medium intensity capacitor coupled across said at least one strobe light; and at least one low intensity capacitor coupled across said at least one strobe light; and a plurality of capacitor switches coupled to said plurality of capacitors including at least one high intensity switch coupled to said at least one high intensity capacitor and at least one medium intensity switch coupled to said at least one medium intensity capacitor; and a control module in communication with said at least one input source, said plurality of switches, and said at least one trigger switch, said control module being adapted for controlling operation of said plurality of capacitor switches based on said request for change in lighting intensity from said input source, said control module executes said request to first inhibit operation of said plurality of strobe lights for a predetermined delay period, then activates at least one said plurality of capacitor switches to effect said change in lighting intensity, and subsequently permits operation of said plurality of strobe lights.

2. The system of claim 1, wherein said control module includes:

a processor in communication with said at least one input source for receiving said request for change in lighting intensity;

an insulated strobe on/off switch in communication with said processor;

a plurality of insulated trigger switches in communication with said processor and in downstream communication with said insulated strobe on/off switch and in upstream communication with said at least one strobe trigger switch of said charge and discharge circuitry;

at least one insulated strobe intensity switch in downstream communication with said insulated strobe on/off switch and in upstream communication with at least one of said plurality of capacitor switches; and wherein said processor inhibits communication with said plurality of insulated trigger switches for said predetermined delay period thereby permitting voltage to substantially equalize across said plurality of capacitors, and thereafter sends a trigger signal to said plurality of insulated trigger switches for activating said at least one said plurality of capacitor switches to charge said associated one of said plurality of capacitors.

3. The system of claim 2 wherein each of said plurality of insulated trigger switches is independently fused downstream thereof.

4. The system of claim 3 wherein each of said plurality of insulated trigger switches includes an opto-coupler and alternistor.

5. The system of claim 4 wherein each of said plurality of insulated trigger switches includes a shunt resistor downstream thereof to lower output impedance and minimize generation of high voltage buildup of transients.

6. The system of claim 2 wherein said control module includes a selectable AC or DC triggering arrangement including a fuse insertable one at a time in an AC fuse socket and a DC fuse socket, wherein removal of said fuse from said AC fuse socket and into said DC fuse socket routes rectified power to said plurality of triggers.

7. The system of claim 2 wherein said plurality of insulated trigger switches includes a plurality of insulated flasher trigger switches and a pair insulated REIL trigger switches whose operation is synchronized with that of said plurality of insulated flasher trigger switches.

8. The system of claim 7 wherein said pair of insulated REIL trigger switches are simultaneously triggered after a predetermined delay period after said plurality of insulated flasher trigger switches have been sequentially triggered.

9. The system of claim 1 wherein said plurality of lights further includes a plurality of steady burner lights being communicated to a transformer at a secondary side thereof, said transformer having a primary side with a plurality of taps including at least low, medium, and high taps that correspond respectively to said low, medium, and high states of said plurality of lights, said system further comprising:

a plurality of power input lines communicated to said plurality of taps, said plurality of power input lines including a low line, a medium line, and a high line corresponding respectively to said low, medium, and high taps;

a plurality of tap switches for switching between said plurality of taps of said transformer, said plurality of tap switches including a low tap switch in said low line, a medium tap switch in said medium line, and a high tap switch in said high line; and said control module being adapted to control operation of said plurality of tap switches in a predetermined sequential manner based on input received from said input source, said control module activates at least one of said plurality of switches in response to said request for an increase in lighting intensity from said input source, said control module activates another of said plurality of switches, wherein a delay period is applied before said control module activates said another of said plurality of switches, thereby avoiding overlap operation of said plurality of switches.

10. The system of claim 9 wherein said control module is adapted for effecting a change in intensity of said plurality of steady burner lights before effecting a change in intensity of said plurality of strobe lights, wherein said control module commands operation of said plurality of tap switches and thereafter commands operation of said plurality of capacitor switches.

11. The system of claim 1 wherein said plurality of lights further includes a plurality of steady burner lights being communicated to a transformer at a secondary side thereof, said transformer having a primary side with a plurality of taps including at least low, medium, and high taps that correspond respectively to said low, medium, and high states of said plurality of lights, said system further comprising:

a plurality of power input lines communicated to said plurality of taps, said plurality of power input lines including a low line, a medium line, and a high line corresponding respectively to said low, medium, and high taps;

a plurality of tap switches for switching between said plurality of taps of said transformer, said plurality of tap switches including a low tap switch in said low line, a medium tap switch in said medium line, and a high tap switch in said high line;

said control module being adapted to control operation of said plurality of tap switches in a predetermined sequential manner based on input received from said input source, said control module activates at least one of said plurality of switches in response to said request for an increase in lighting intensity from said input source, said control module activates another of said plurality of switches, wherein said low tap switch is activated for a first predetermined time interval before activating said medium tap switch for at least a second predetermined time interval.

12. The system of claim 11 further comprising:

a common power line connected to said transformer;

at least one switch in said common power line for switching AC power flowing therethrough; and at least one solid state relay in series with said switch in said common power line;

said control module being adapted to command said at least one solid state relay on after said at least one switch has transitioned on, and to command said at least one solid state relay off before said at least one switch transitions off, thereby enabling said control module to activate and deactivate said plurality of switches substantially when said power therethrough is substantially zero.

13. The system of claim 12 wherein said control module further includes:

a processor in communication with said at least one input source for receiving said request for change in lighting intensity; and an over-voltage protection circuit interposed between said processor and said common power line, wherein said processor is adapted to prevent operation of said plurality of steady burner lights in said high intensity mode when voltage in said common power line exceeds a predetermined over-voltage threshold.

* * * * *

UNITED STATES PATENT AND TRADEMARK OFFICE

CERTIFICATE OF CORRECTION

PATENT NO. : 7,088,263 B1
APPLICATION NO. : 10/942067
DATED : August 8, 2006
INVENTOR(S) : Kenneth Nicholas Krause and Vincent Robert Busby It is certified that error appears in the above-identified patent and that said Letters Patent is hereby corrected as shown below:

Column 9, line 35, delete "FIGS. 1-11H" and insert therein -- FIGS. 1-1H --.

Signed and Sealed this

Tenth Day of October, 2006

JON W. DUDAS
*Director of the United States Patent and Trademark Office*